US007236725B2

(12) United States Patent
Inukai et al.

(10) Patent No.: US 7,236,725 B2
(45) Date of Patent: Jun. 26, 2007

(54) IMAGE FORMATION DEVICE ENABLING SWITCHING BETWEEN COLOR PRINTING MODE AND MONOCHROME PRINTING MODE

(75) Inventors: Hideaki Inukai, Nagano-ken (JP); Nobuaki Takenaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 193 days.

(21) Appl. No.: 11/028,508

(22) Filed: Jan. 4, 2005

(65) Prior Publication Data

US 2005/0207789 A1 Sep. 22, 2005

(30) Foreign Application Priority Data

Jan. 7, 2004 (JP) ..... 2004-001718

(51) Int. Cl.
*G03G 15/01* (2006.01)

(52) U.S. Cl. ..... 399/223; 399/227

(58) Field of Classification Search ..... None
See application file for complete search history.

(56) References Cited

U.S. PATENT DOCUMENTS 5,784,665 A * 7/1998 Bae ..... 399/13
6,029,018 A * 2/2000 Rogers et al. ..... 399/12
2004/0051891 A1* 3/2004 Moro et al. ..... 358/1.9

FOREIGN PATENT DOCUMENTS

| | | | |
|---|---|---|---|
| JP | 05-053404 | B1 | 3/1993 |
| JP | 09-085967 | B1 | 3/1997 |
| JP | 2001-188406 | A1 | 7/2001 |
| JP | 2002-351190 | A | 12/2002 |
| JP | 2003-43773 | A | 2/2003 |
| JP | 2003-208064 | A1 | 7/2003 |
| JP | 2003-208076 | A1 | 7/2003 |
| JP | 2003-316106 | A | 11/2003 |

* cited by examiner

*Primary Examiner*—Vincent Q. Nguyen
(74) *Attorney, Agent, or Firm*—Sughrue Mion, PLLC

(57) ABSTRACT

An image formation device has an image carrier in which are formed latent images, and a development device into which development units housing toner are detachably installed. When development units with a plurality of colors are installed in respective installation positions of the development device, the image formation device operates in color printing mode, and when at least one black development unit is installed in any among the plurality of installation positions, and at least one among the development units with the colors other than black is not installed, even if at least one development unit in the plurality of colors other than black is installed, the image formation device operates in monochrome printing mode. When any of the C, M, and Y development units is removed from color mode state, the image formation device operates in monochrome printing mode.

12 Claims, 17 Drawing Sheets

FIG. 9

| CASE | DEVELOPMENT UNIT | | | | PRINTING MODE | DECISION CONDITIONS | |
|---|---|---|---|---|---|---|---|
| | PK | PC | PM | PY | | | |
| 1 | K | C | M | Y | COLOR PRINTING MODE | KCMY ARE INSTALLED AT PREDETERMINED POSITIONS | |
| 2 | K | C | M | | MONOCHROME PRINTING MODE | [CONDITION 1] (1) AT LEAST ONE K IS INSTALLED, (2) AT LEAST ONE OF CMY IS NOT INSTALLED, (3) AT LEAST ONE OF CMY IS INSTALLED | [CONDITION 3] (1) AT LEAST ONE K IS INSTALLED, (2) NO CONDITION AT REMAINING POSITIONS, (3) INSTALLATION IS NOT KCMYK |
| 3 | K | C | | Y | MONOCHROME PRINTING MODE | | |
| 4 | K | | M | Y | MONOCHROME PRINTING MODE | | |
| 5 | K | C | | | MONOCHROME PRINTING MODE | | |
| 6 | K | | M | | MONOCHROME PRINTING MODE | | |
| 7 | K | | | Y | MONOCHROME PRINTING MODE | | |
| 8 | K | | | | MONOCHROME PRINTING MODE | ONLY K IS INSTALLED AT PREDETERMINED POSITION | |
| 9 | K | C | M | K | MONOCHROME PRINTING MODE | [CONDITION 2] (1) PLURAL KS ARE INSTALLED AT ANY POSITIONS, (2) AT LEAST ONE OF CMY IS INSTALLED | |
| 10 | K | C | K | Y | MONOCHROME PRINTING MODE | | |
| 11 | K | K | M | Y | MONOCHROME PRINTING MODE | | |
| 12 | K | C | K | | MONOCHROME PRINTING MODE | | |
| 13 | K | C | | K | MONOCHROME PRINTING MODE | | |
| 14 | K | C | K | K | MONOCHROME PRINTING MODE | | |
| 15 | K | K | M | | MONOCHROME PRINTING MODE | | |
| 16 | K | | M | K | MONOCHROME PRINTING MODE | | |
| 17 | K | K | M | K | MONOCHROME PRINTING MODE | | |
| 18 | K | K | | Y | MONOCHROME PRINTING MODE | | |
| 19 | K | | K | Y | MONOCHROME PRINTING MODE | | |
| 20 | K | K | K | Y | MONOCHROME PRINTING MODE | | |
| 21 | K | K | K | K | MONOCHROME PRINTING MODE | ONLY KS ARE INSTALLED | |

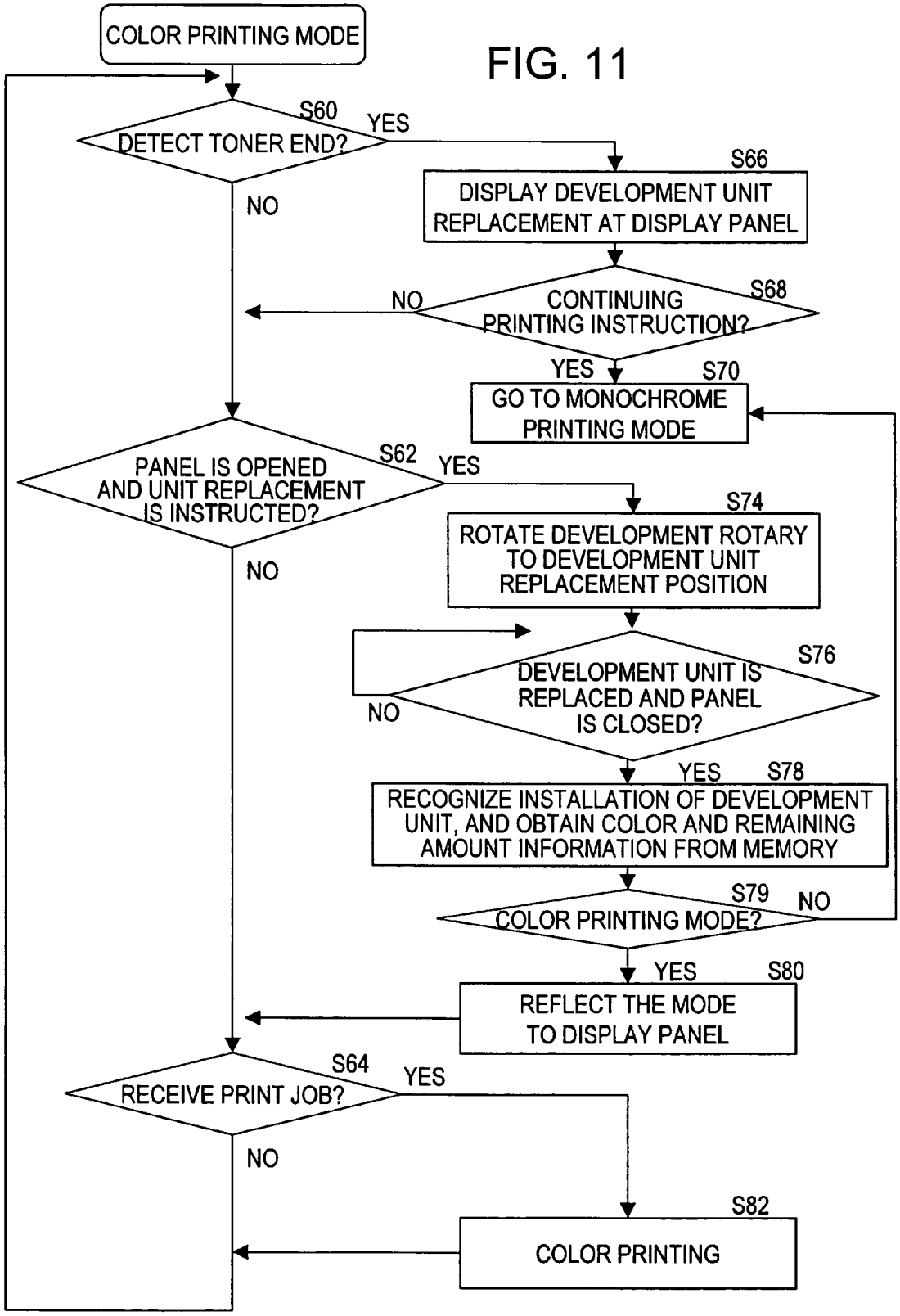
COLOR PRINTING MODE
FIG. 11
S60
DETECT TONER END?
YES
NO
S66
DISPLAY DEVELOPMENT UNIT REPLACEMENT AT DISPLAY PANEL
S68
CONTINUING PRINTING INSTRUCTION?
NO
YES
S70
GO TO MONOCHROME PRINTING MODE
S62
PANEL IS OPENED AND UNIT REPLACEMENT IS INSTRUCTED?
YES
NO
S74
ROTATE DEVELOPMENT ROTARY TO DEVELOPMENT UNIT REPLACEMENT POSITION
S76
DEVELOPMENT UNIT IS REPLACED AND PANEL IS CLOSED?
NO
YES
S78
RECOGNIZE INSTALLATION OF DEVELOPMENT UNIT, AND OBTAIN COLOR AND REMAINING AMOUNT INFORMATION FROM MEMORY
S79
COLOR PRINTING MODE?
NO
YES
S80
REFLECT THE MODE TO DISPLAY PANEL
S64
RECEIVE PRINT JOB?
YES
NO
S82
COLOR PRINTING

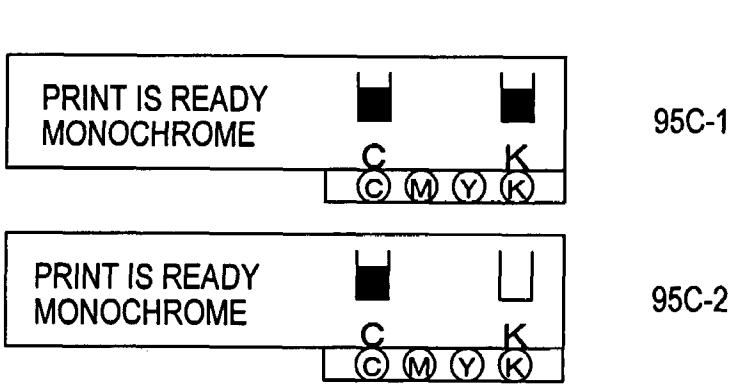
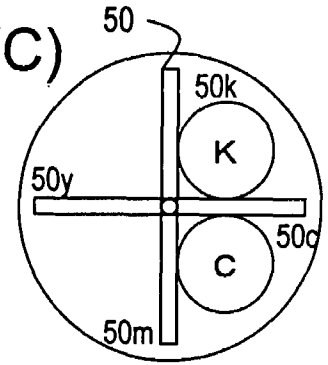
FIG. 12(C)
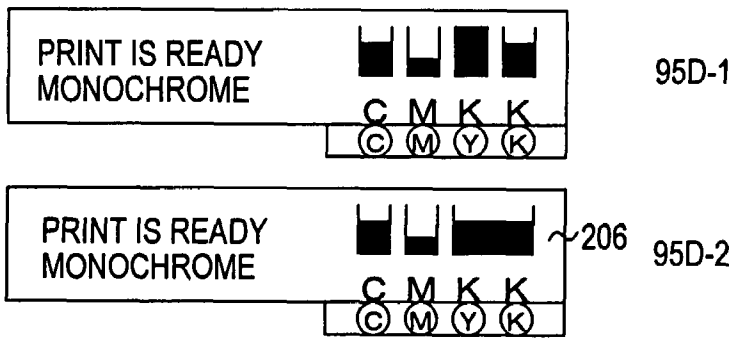
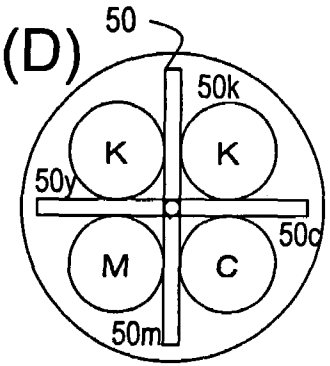
FIG. 12(D)

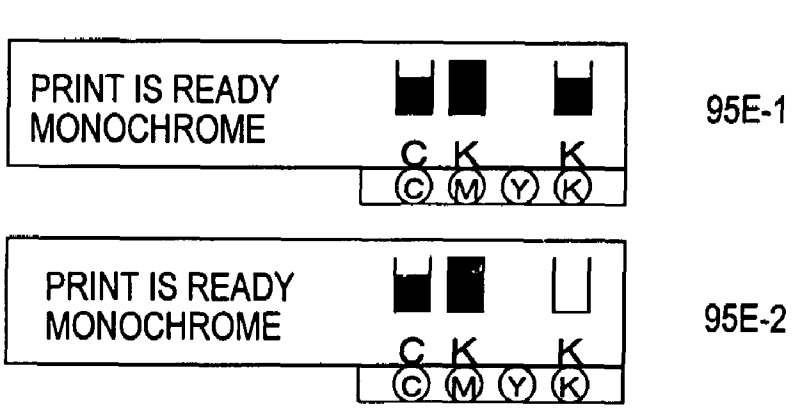
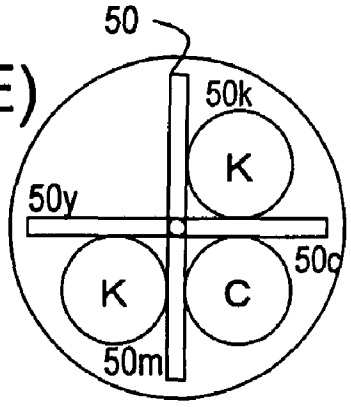
FIG. 13(E)
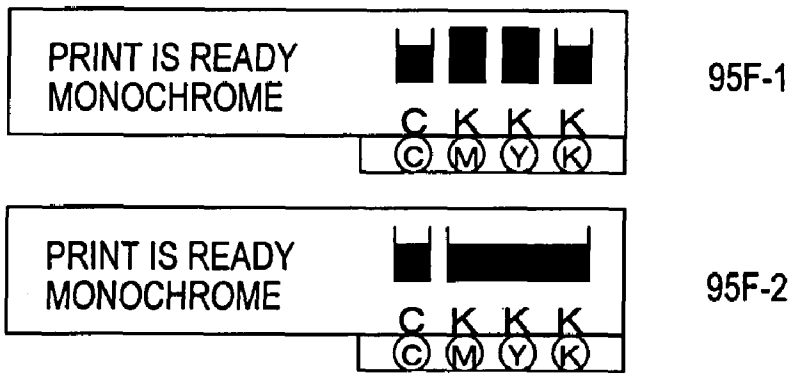
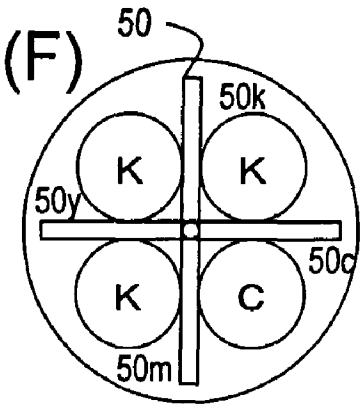
FIG. 13(F)

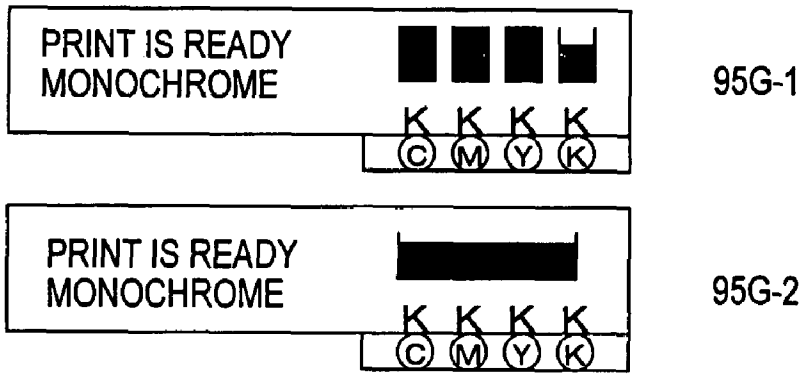
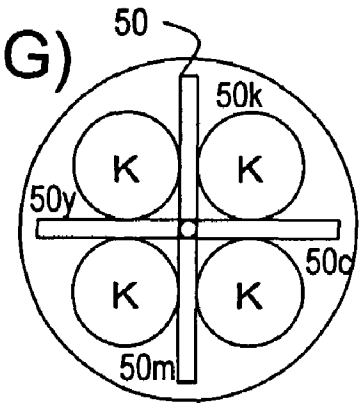
FIG. 13(G)
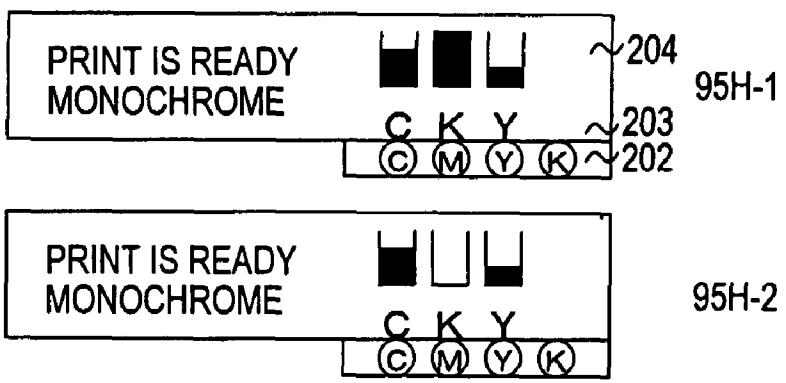
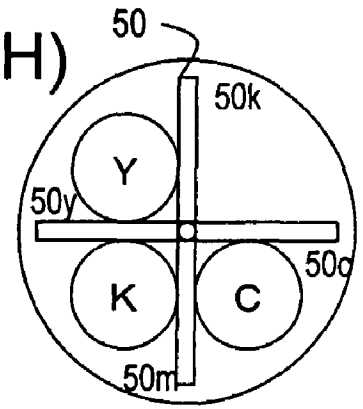
FIG. 13(H)

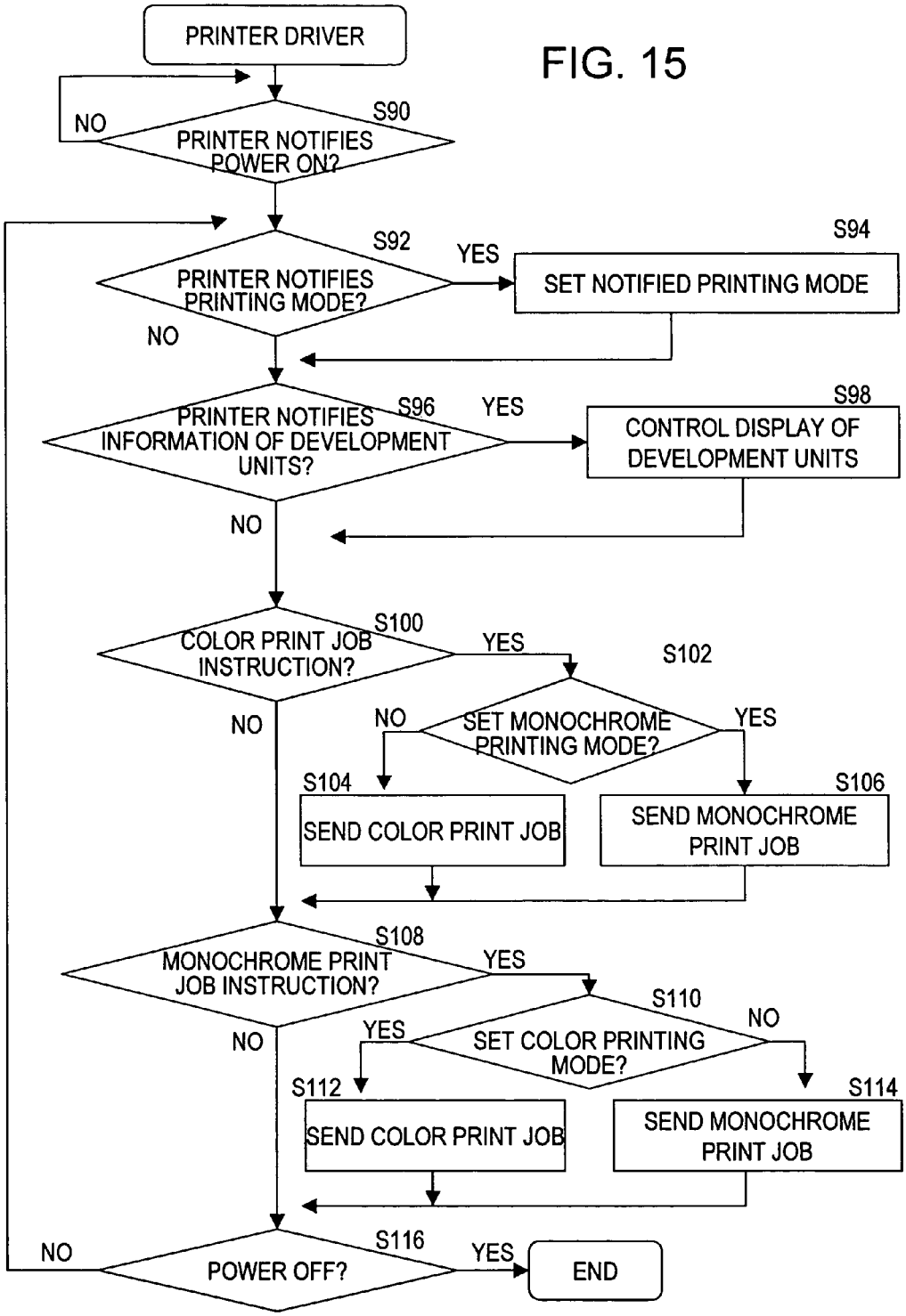
PRINTER DRIVER
FIG. 15
S90
PRINTER NOTIFIES POWER ON?
NO
S92
PRINTER NOTIFIES PRINTING MODE?
YES
S94
SET NOTIFIED PRINTING MODE
NO
S96
PRINTER NOTIFIES INFORMATION OF DEVELOPMENT UNITS?
YES
S98
CONTROL DISPLAY OF DEVELOPMENT UNITS
NO
S100
COLOR PRINT JOB INSTRUCTION?
YES
S102
SET MONOCHROME PRINTING MODE?
NO
YES
NO
S104
SEND COLOR PRINT JOB
S106
SEND MONOCHROME PRINT JOB
S108
MONOCHROME PRINT JOB INSTRUCTION?
YES
S110
SET COLOR PRINTING MODE?
YES
NO
NO
S112
SEND COLOR PRINT JOB
S114
SEND MONOCHROME PRINT JOB
S116
POWER OFF?
NO
YES
END

IMAGE FORMATION DEVICE ENABLING SWITCHING BETWEEN COLOR PRINTING MODE AND MONOCHROME PRINTING MODE

BACKGROUND OF THE INVENTION

1. Field of the Invention

This invention relates to a color printer, fax machine, photocopier, or other image formation device which forms images using electrophotographic technology, and in particular relates to an image formation device enabling switching between a color printing mode and a monochrome printing mode, and which moreover affords increased flexibility in mounting a developing unit in the monochrome printing mode.

2. Description of the Related Art

Image formation devices which form images using electrophotographic technology, provided for example in color printers, have an image carrier in which is formed an electrostatic latent image according to image data; a charging unit which charges the outer surface of the image carrier; an exposure unit which exposes the outer surface of the charged image carrier according to image data, to form an electrostatic latent image; a developer device which supplies toner, as a developing agent, to the electrostatic latent image to develop a toner image; and a transfer unit which causes the toner image to be transferred to a media. The developer device detachably holds a plurality of developing units which house color toners, and has a developer unit holder which causes the appropriate developer unit to be brought into proximity with the image carrier according to the development timing. This developer unit holder is normally a rotatably controlled developing rotary. When performing color printing, development units with color toner in a plurality of colors, for example, four colors (yellow or Y, magenta or M, cyan or C, and black or K) is mounted in the developing rotary. When performing monochrome printing, a black development unit is mounted in the developing rotary.

An image formation device has been proposed which can be put into a color printing mode in which a four-color development unit is mounted, or into a monochrome printing mode in which only a black development unit is mounted, with the user able to switch between the two modes as appropriate. Such an image formation device has been proposed in, for example, Japanese Patent Laid-open No. 2003-43773 (Publication Date: Feb. 14, 2003), Japanese Patent Laid-open No. 2003-316106 (Publication Date: Nov. 6, 2003), and Japanese Patent Application No. 2003-160059.

In Japanese Patent Laid-open No. 2003-43773 and Japanese Patent Application No. 2003-160059, an image formation device is disclosed in which the color printing mode is set when four color development units are mounted in the developing rotary, and the monochrome printing mode is set when a single black development unit is mounted only in the mounting position for the black development unit of the developing rotary, with no development units mounted in the other mounting positions, which are CMY positions.

In Japanese Patent Laid-open No. 2003-316106, an image formation device is disclosed in which the mounting positions in the developing rotary are not in fixed one-to-one correspondence with development units in four colors, and a development unit of an arbitrary color can be mounted in an arbitrary mounting position. In this image formation device, information on the color of the developing agent is read from memory provided in the development unit, to detect which color development units are mounted in which positions of the developing rotary, and based on the detected positions, rotation of the developing rotary is controlled in the development process. Specifically, in Japanese Patent Laid-open No. 2003-316106, when development units in the four CMYK colors are mounted, the device operates as a color printer, and when only the black development unit is mounted, the device operates as a black monochrome printer.

Further, an image formation device has been proposed in which, by mounting black development units in all four of the mounting positions of the developing rotary and setting the monochrome printing mode, the number of times development units need to be replaced can be reduced. Such an image formation device is disclosed in Japanese Patent Laid-open No. 2002-351190 (Publication Date: Dec. 4, 2002). In this image formation device, by mounting four black development units in the four mounting positions of the developing rotary for color printing, reading memory provided in the development units, detecting the mounting positions, color information, and amount of toner remaining, and by using the black development units in order, the frequency of replacement of development units in monochrome printing mode can be reduced, even for small-type development devices.

Japanese Patent Laid-open No. 2003-43773, Japanese Patent Laid-open No. 2003-316106, and Japanese Patent Application No. 2003-160059 all disclose image formation devices capable of switching between a color printing mode and a monochrome printing mode; but in all cases, a four color (CMYK) development units must be installed in order to switch to color printing mode, whereas in order to switch into monochrome printing mode, only a development unit of the same color (for example, black) need be installed. Consequently in order to switch from a color printing mode to a monochrome printing mode, of the four color (CMYK) development units, the three color (CMY) development units other than black must be removed. Conversely, in order to switch from the monochrome printing mode to the color printing mode, three color (CMY) development units must be installed in addition to the already-installed black development unit.

For example, the image formation devices of Japanese Patent Laid-open No. 2003-43773 and Japanese Patent Application No. 2003-160059 operate in color printing mode when four color (CMYK) development units are installed in fixed positions of the development rotary, and operate in monochrome printing mode when a black development unit is installed in the black position of the development rotary. Hence in order to switch from color printing mode into monochrome printing mode, the three color (CMY) development units other than black must all be removed. If any of the three color (CMY) development units is left in the installed state, the device does not enter the monochrome printing mode; and if even one of the three colors (CMY) is not installed, the device does not enter the color printing mode either, and an error occurs. Further, in order to switch from monochrome printing mode into color printing mode, three color (CMY) development units must be installed, and there is the problem of considerable inconvenience for the user.

Even when in color printing mode, if a monochrome print job is requested, monochrome printing is possible; but in order to put the device into a dedicated monochrome printing mode, the device must be put into a state in which only a black development unit is installed.

In the image formation device of Japanese Patent Laid-open No. 2003-316106, while installation of four color (CMYK) development units in arbitrary position is permitted in color printing mode, in order to switch into monochrome printing mode, the device must be put into a state in which only a black development unit is installed, so that once again, there is the problem of considerable inconvenience for the user.

Further, in Japanese Patent Laid-open No. 2003-43773, Japanese Patent Laid-open No. 2003-316106, Japanese Patent Application No. 2003-160059, and Japanese Patent Laid-open No. 2002-351190, there is no statement of methods for displaying to the user position information, color information, remaining amount information, or similar for installed development units. In order to enable easy switching between color printing mode and monochrome printing mode, the manner of display to the user of the position, color, and remaining toner amount for installed development units is important in order to improve convenience to the user.

Hence an object of this invention is to provide an image formation device capable of simplifying complex operations necessary for switching between color printing mode and monochrome printing mode, in order to improve convenience to the user.

A further object of this invention is to provide an image formation device which enables display of the positions, colors, and amounts of toner remaining in installed development units, to improve convenience to the user.

SUMMARY OF THE INVENTION

In order to attain the above objects, in a first aspect of the invention, an image formation device comprises an image carrier in which latent images are formed, and a development device into which a plurality of development units housing developing material are detachably installed. Further, when development units with a plurality of colors to form color images are installed in a plurality of installation positions of said development device, respectively, the image formation device operates in color printing mode; and when at least one black development unit among said development units of the plurality of colors is installed in any position among said plurality of installation positions, and at least one among said development units of a plurality of colors other than black is not installed, even if at least one among said development units of the plurality of colors other than black is installed, the image formation device operates in monochrome printing mode.

In order to attain the above objects, in a second aspect of the invention, an image formation device comprises an image carrier in which latent images are formed, and a development device into which a plurality of development units housing developing material are detachably installed. Further when development units with a plurality of colors to form color images are installed in a plurality of installation positions of said development device, respectively, the image formation device operates in color printing mode; and when a plurality of black development units among said development units of the plurality of colors are installed in any of the positions among said plurality of installation positions, even if at least one among said development units of a plurality of colors other than black is installed, the image formation device operates in monochrome printing mode.

In order to attain the above objects, in a third aspect of the invention, an image formation device comprises an image carrier in which latent images are formed, and a development device into which a plurality of development units housing developing material are detachably installed. Further, when development units with a plurality of colors to form color images are installed in a plurality of installation positions of said development device, respectively, the image formation device operates in color printing mode; and when all of said development units with the a plurality of colors are not installed, but at least one black development unit among said development units in the plurality of colors is installed in any of the positions among said plurality of installation positions, regardless of the installation states of said installation positions in which the black development unit is not installed, the image formation device operates in monochrome printing mode.

In order to attain the above objects, in a fourth aspect of the invention, an image formation device comprises an image carrier in which latent images are formed, and a development device into which a plurality of development units housing developing material are detachably installed. Further, when development units with a plurality of colors to form color images are installed in a plurality of installation positions of said development device, respectively, the image formation device operates in color printing mode; when all of said development units with the plurality of colors are not installed, but a black development unit among said development units with the plurality of colors is installed in any of the positions among said plurality of installation positions, the image formation device operates in monochrome printing mode; said development units have storage device for storing color information and amount remaining information for the developing material housed therein; and, said image formation device further comprises display unit for displaying, for each of said plurality of installation positions, information indicating whether said development units is installed, and the color information and amount remaining information for developing material in the installed development units, according to the color information and amount remaining information stored in said storage device of development units installed in said development device.

In order to attain the above objects, in a fifth aspect of the invention, an image formation device comprises an image carrier in which latent images are formed, and a development device into which a plurality of development units housing developing material are detachably installed. Further, when development units with a plurality of colors to form color images are installed in a plurality of installation positions of said development device, respectively, the image formation device operates in color printing mode; when all of said development units with the plurality of colors are not installed, but a black development unit among said development units with the plurality of colors is installed in any of the positions among said plurality of installation positions, the image formation device operates in monochrome printing mode; said development units have storage device for storing color information and amount remaining information for the developing material housed therein; and, said image formation device further comprises control unit for outputting, to a host computer connected to the image formation device, data for displaying, for said plurality of installation positions, information indicating whether said development units are installed, and the color information and amount remaining information for developing material in installed development units, according to the color information and amount remaining information stored in said storage device of development units installed in said development device.

In the first aspect, when development units in a plurality of colors for color printing are installed, the image formation device operates in color printing mode; in this case, if at least one among the plurality of development units other than the black development unit is removed, the image formation device operates in monochrome printing mode, so that necessary operations accompanying switching between color printing mode and monochrome printing mode can be simplified, and convenience to the user can be improved. In monochrome printing mode, only black monochrome printing operation is possible, so that the device can be used as a dedicated monochrome printer. On the other hand, in color printing mode, if a monochrome printing command is issued by the printer driver, monochrome printing can also be performed, but color printing cannot be forbidden.

In the second aspect, when development units in a plurality of colors for color printing are installed, the device operates in color printing mode; in this case, if at least one among the plurality of development units other than the black development unit is removed, even if a black development unit is installed in the place thereof, the device operates in monochrome printing mode, and so operations necessary for switching between color printing mode and monochrome printing mode can be simplified, and a plurality of black development units can be installed to perform monochrome printing, so that the frequency of replacement of development units can be reduced and convenience to the user can be improved. Similarly to the first aspect, in monochrome printing mode the device operates only to perform black monochrome printing, and so can be used as a dedicated monochrome printer; on the other hand, in color printing mode, if a monochrome printing command is issued by the printer driver, monochrome printing can also be performed, but color printing cannot be forbidden.

In the third aspect, when developer units in a plurality of colors for color printing are installed, the device operates in color printing mode; on the other hand, if a black development unit is installed in any of the installation positions of the development device, the image formation device operates in monochrome printing mode, regardless of the state of installation of other installation positions, so that there is an increased number of combinations of development units enabling operation in monochrome printing mode, and convenience to the user can be improved. Similarly to the first aspect, in monochrome printing mode the device can only operate to perform black monochrome printing, and so can be used as a dedicated monochrome printer, whereas in color printing mode, if a monochrome printing command is issued from the printer driver, monochrome printing is also possible, but color printing cannot be forbidden.

According to fourth and fifth aspects, since black development units are allowed to be installed in arbitrary positions and in an arbitrary number in monochrome printing mode, information for corresponding installation positions indicating whether development units are installed, information on the color of the developing material and on the amount of material remaining, is displayed, so that monochrome development unit replacement tasks can be facilitated.

BRIEF DESCRIPTION OF THE DRAWINGS

FIG. 9 shows a decision table in printing mode decision operation;

FIG. 11 is a flowchart showing operation in color printing mode;

FIG. 13 shows examples of a development unit installation state and display panel display;

DESCRIPTION OF THE PREFERRED EMBODIMENTS

Figure 1:
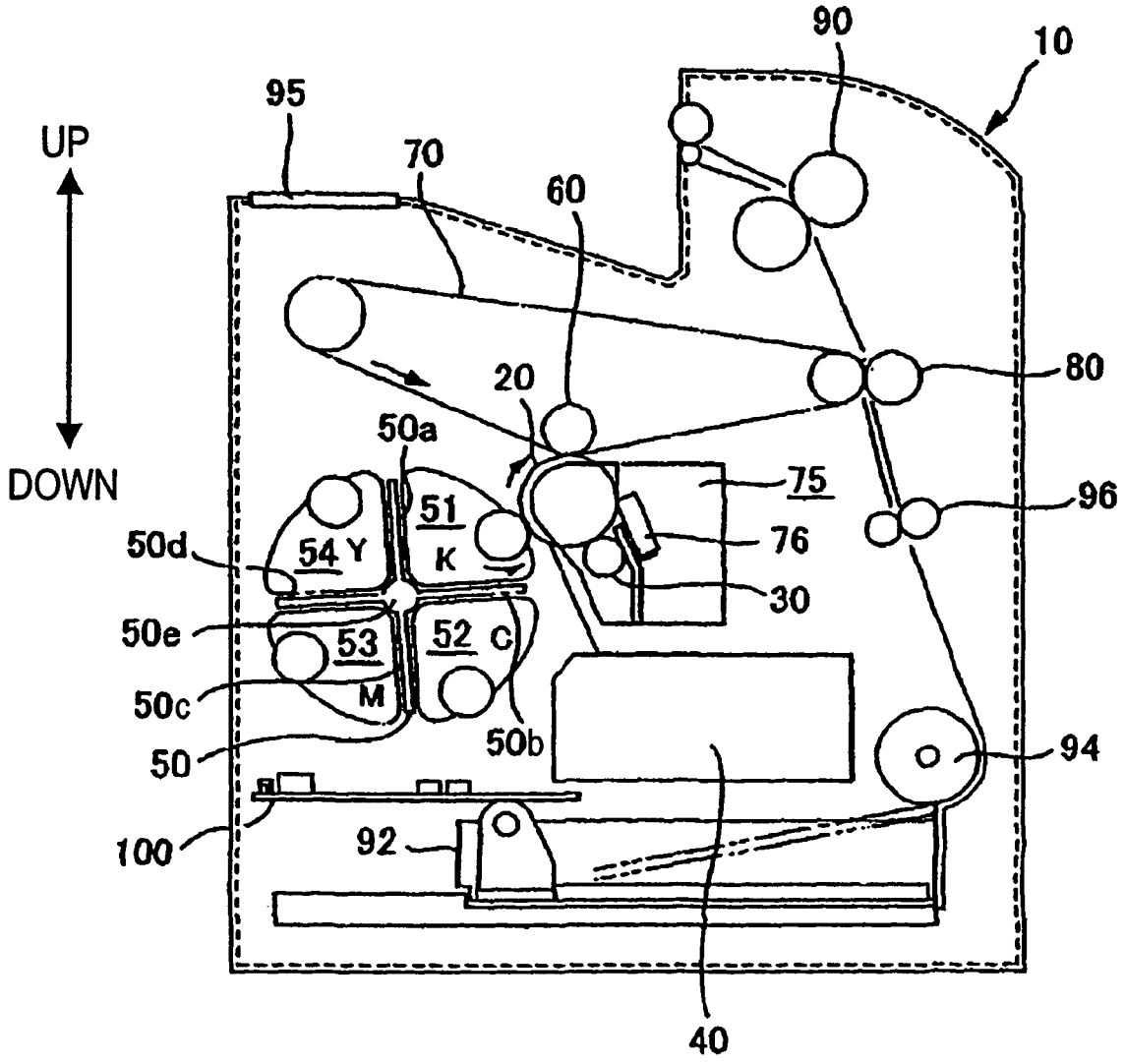
FIG. 1 shows the principal configuration of an image formation device (when in color printing mode) in a present embodiment.

Below, the embodiments of the invention are explained referring to the drawings. However, the technical scope of the invention is not limited to these aspects, but extends to the inventions described in the scope of claims and to inventions equivalent thereto.

FIG. 1 shows the principal configuration of the image formation device of the embodiment. This embodiment is explained taking a laser beam printer 10 as an example of an image formation device. The printer 10 in FIG. 1 is shown in a configuration for the color printing mode.

The printer 10 has, in order in the direction of rotation of the photosensitive drum 20 which is the image carrier carrying latent images, a charging unit 30; an exposure unit 40; a developer 50; a primary transfer unit 60; an intermediate transfer member 70; and a cleaning unit 75. The printer 10 further has a secondary transfer unit 80; a fixing unit 90; a display unit 95 which displays various information to the user; and a control unit 100 which controls these units. The control unit 100 differs from FIG. 1 in being mounted in the vertical direction with respect to the printer 10.

The photosensitive drum 20 has a cylindrical conductive base and a photosensitive layer formed on the outer surface thereof, is rotatable about the center axis, and rotates in the clockwise direction, as indicated by an arrow. The charging unit 30 charges the photosensitive drum 20, and the exposure unit 40 irradiates the charged photosensitive drum 20 with a beam from an internal laser, LED array, or other light source, to form a latent image due to static charge on the photosensitive drum 20. The beam irradiation by the exposure unit 40 is controlled by a driving signal, modulated based on image information input from a host computer.

The development device 50 has mounting portions 50*a* through 50*d*, into which development units 51 through 54 housing the toner as the developing agent can be detachably mounted, and is a developing rotary, rotatable about the central axis 50*e*. By causing the development device 50 to rotate, bringing the necessary development units 51 through 54 into proximity with the photosensitive drum 20, and supplying the developing agent to the photosensitive drum 20 on which a latent image is formed, the latent image is developed into an image by the developing agent. In the example of FIG. 1, development units 51 through 54, housing developing agents in the colors black (K), cyan (C), magenta (M), and yellow (Y), are respectively mounted in the mounting portions 50*a* through 50*d* of the development device 50, so the printer is put into color printing mode, and in the printing process, the latent image formation on the photosensitive drum 20 and development using the respective developing agents are performed, in the order CMYK. Hence upon each process of latent image formation and development for each color, the development device 50 rotates in the clockwise direction, bringing the development unit of the appropriate color into proximity with the photosensitive drum 20, to perform development in order.

The primary transfer unit 60 transfers the toner image formed on the photosensitive drum 20 to the intermediate transfer member 70. The intermediate transfer member 70 is an endless belt, comprising for example PET film on the surface of which an aluminum evaporation-deposited layer is formed, on the surface of which a semiconducting material is applied, and is driven in rotation at the same angular velocity as the photosensitive drum 20. In color printing mode, images in the CMYK colors are transferred, overlapping, onto the intermediate transfer member 70; in monochrome printing mode, an image in a single color is transferred onto the intermediate transfer member 70. The secondary transfer unit 80 then transfers the toner image formed on the intermediate transfer member 70 to paper or some other printing media, the fixing unit 90 fixes the toner image, transferred onto the printing media, to create a permanent image on the media, and the printing media is then ejected from the printer.

The cleaning unit 75 is provided between the primary transfer unit 60 and the charging unit 30, and has a cleaning blade 76 which is held in contact with the surface of the photosensitive drum 20; after primary transfer, the remaining developing agent (toner) on the photosensitive drum 20 is removed by the cleaning blade 76.

Each of the development units 51 through 54 can be mounted onto and detached from the development device 50, and is provided with storage element, such as for example non-contact and non-volatile memory, which stores color information and remaining amount information for the developing agent. When power is turned on or after a development unit is newly mounted in the development device, the information in the non-volatile memory of the development unit is read. Also, after development, the developing agent remaining amount information in the non-volatile memory of the development unit is updated.

When the CMYK development units 51 through 54 are mounted in arbitrary positions or preferably in their respective predetermined positions in the development device 50, the mounted states are identified by reading information in the above-described non-volatile memory, and the printer 10 operates in color printing mode. In color printing mode, print job data described in a language used for color printing is supplied by the host computer, and formation of electrostatic latent images on the photosensitive drum 20, development by the development unit of the corresponding color, and transfer of the toner image onto the intermediate transfer member 70 by the primary transfer unit 60, are repeated in CMYK order. After the CMYK toner images have been transferred to the intermediate transfer member 70, the color image on the intermediate transfer member 70 is transferred to the paper or other printing media by the secondary transfer unit 80 and is fixed by the fixing unit 90, and the printing media is ejected from the printer.

Even when the CMYK development units for color printing are mounted as shown in FIG. 1, if print job data indicating monochrome printing is supplied by the host computer, development is performed by, for example, the black development unit when black monochrome printing is specified, and the monochrome image is formed on the printing media.

Figure 2:
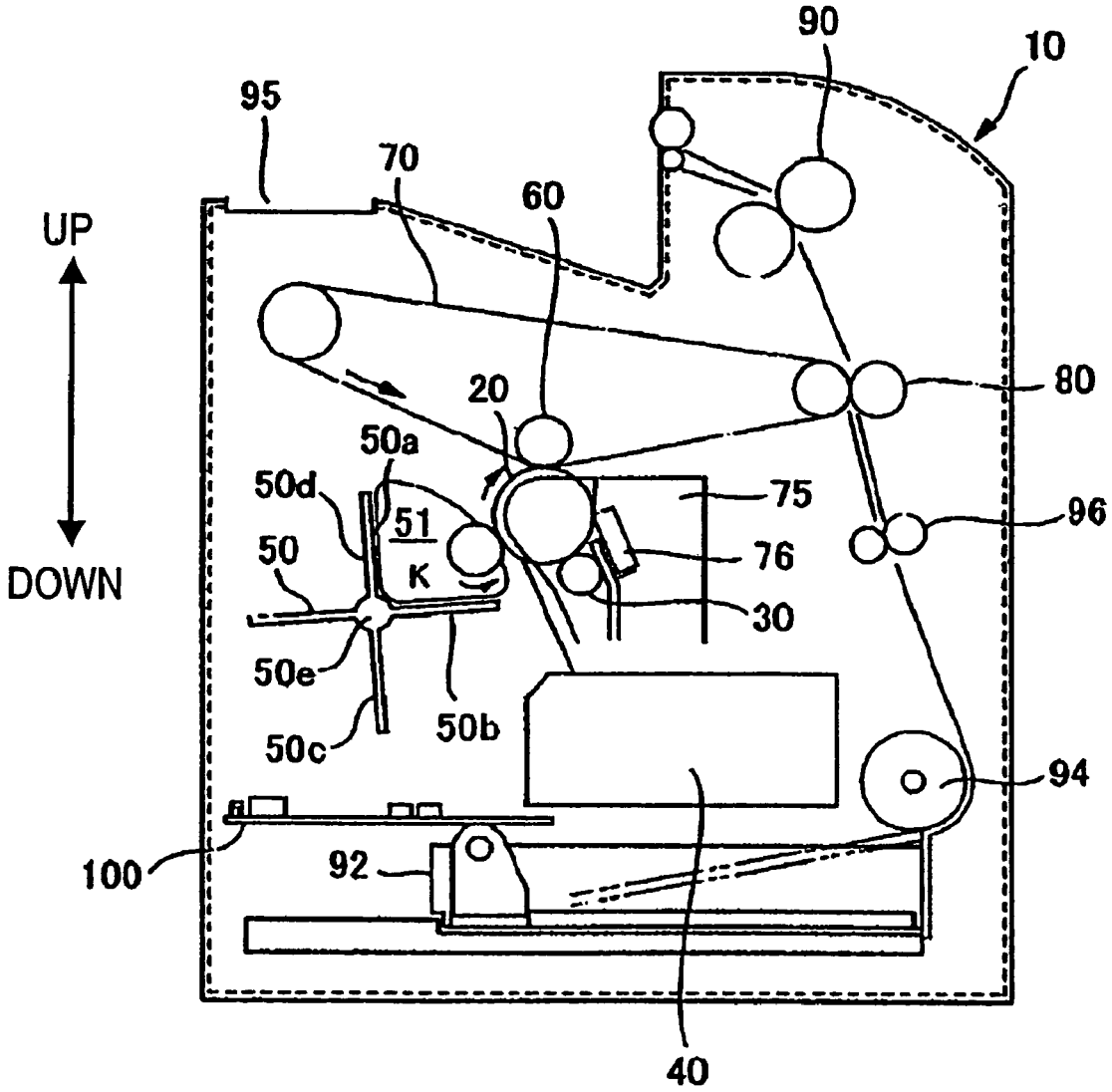
FIG. 2 shows the principal configuration of an image formation device (when in monochrome printing mode) in a present embodiment.
Figure 3:
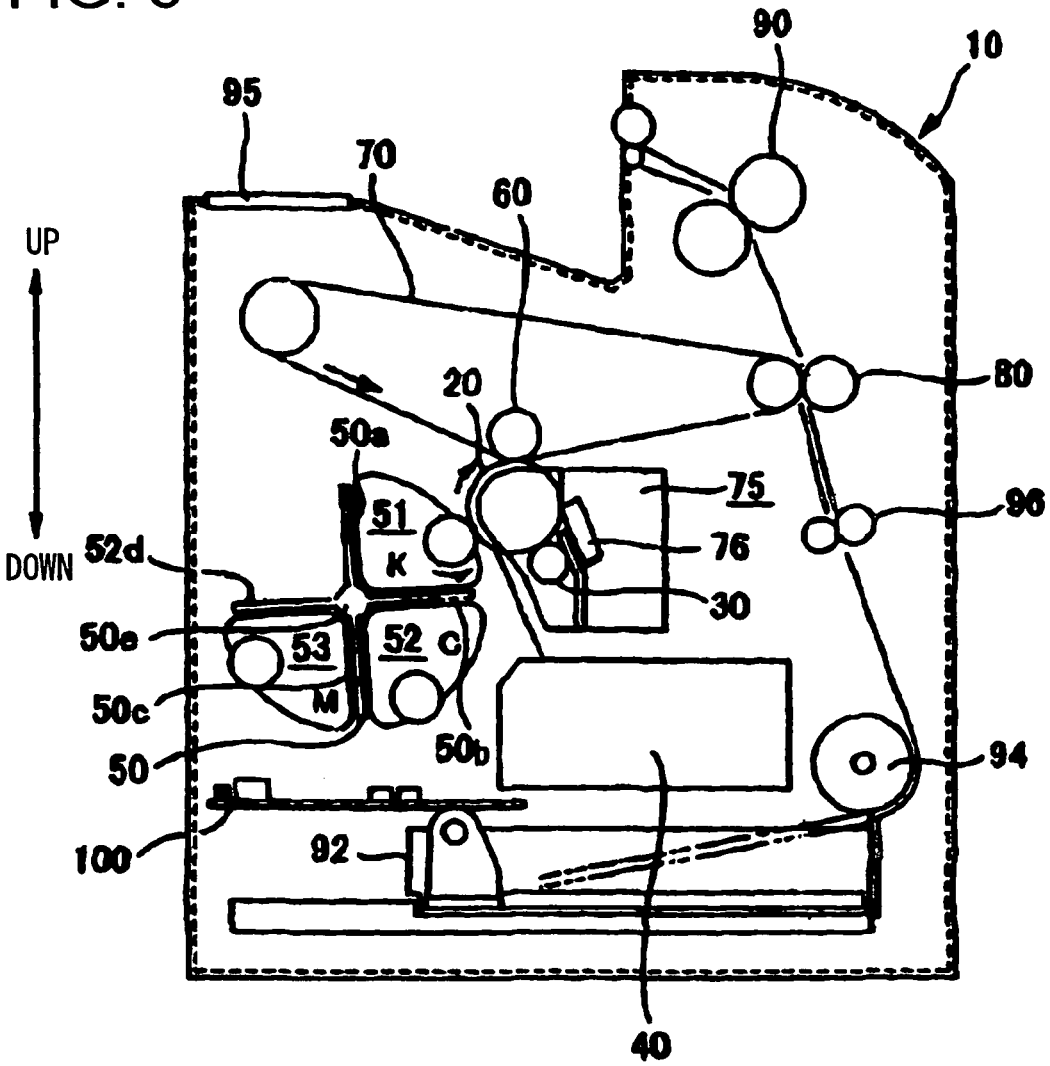
FIG. 3 shows the principal configuration of an image formation device (when in monochrome printing mode) in a present embodiment.
Figure 4:
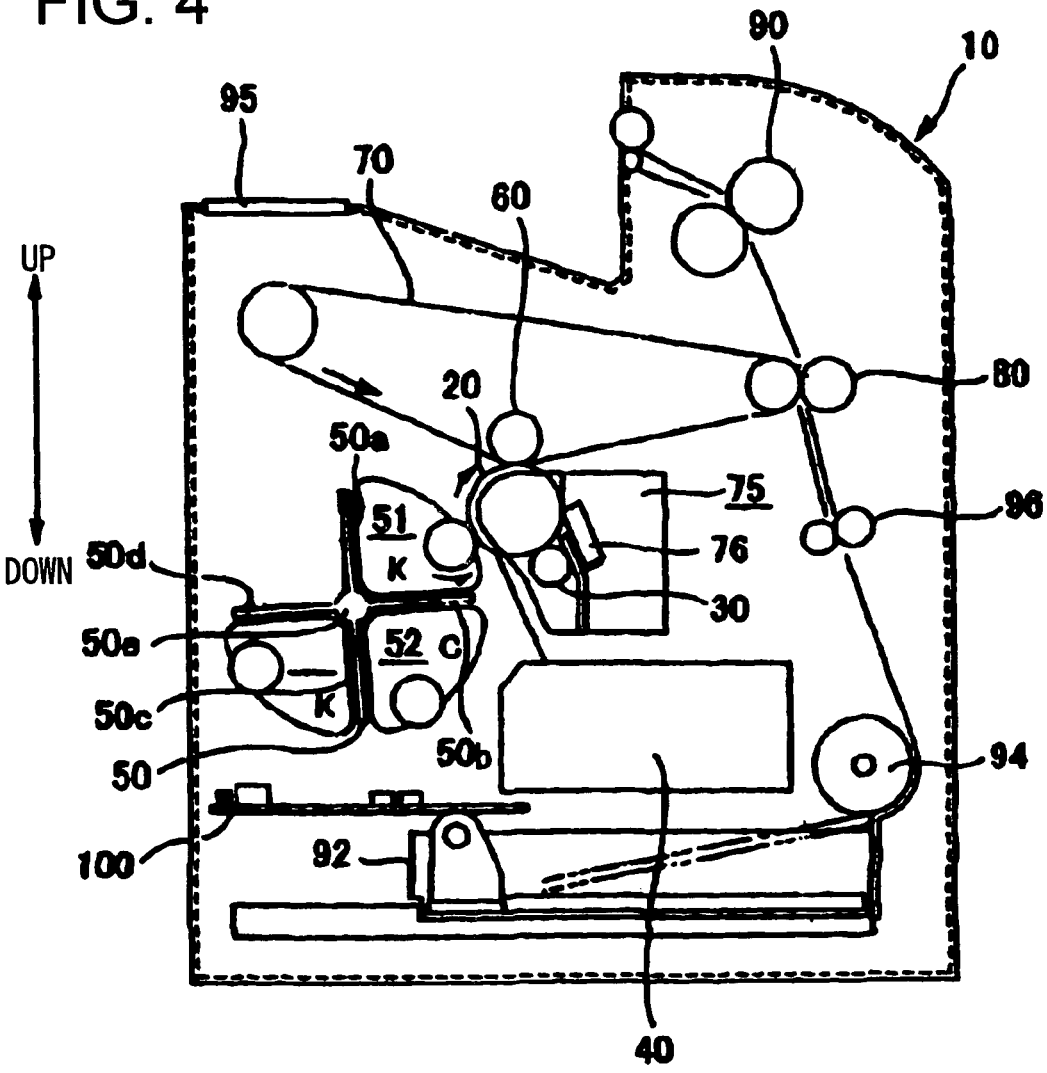
FIG. 4 shows the principal configuration of an image formation device (when in monochrome printing mode) in a present embodiment.

FIG. 2 through FIG. 4 show the principal configuration of the image formation device of the embodiment; in these drawings, the configuration in black monochrome printing mode (single-color printing mode) is shown. In FIG. 2 through FIG. 4, components which are the same as in FIG. 1 are assigned the same reference numbers. In the example of FIG. 2, a black development unit 51 is mounted only in the mounting position 50*a* for a black development unit of the development device 50. In this case, black color information is read from the non-volatile memory provided in the development unit 51, described below, and the control unit 100 detects that a black development unit 51 is mounted in the mounting position 50*a* and that development units are not mounted in the other mounting positions, as a consequence of which the monochrome printing mode is detected. Even when a single or plural black development units are mounted in a mounting position other than the mounting position for black 50*a*, the control unit 100 similarly detects this mounted state, and so detects the black monochrome printing mode. When a monochrome printing mode is detected, the printer driver of the host computer is notified of the mode information, and as a result the host computer supplies print job data in a language for monochrome printing.

In the example of FIG. 3, among the CMYK development units in the development device 50, the yellow (Y) development unit 54 has been removed. In this state, color information in nonvolatile memory provided in the development units 51, 52, 53 is read, the installation state is detected by the control unit, and the device is detected to be in the black monochrome printing mode. That is, when a black (K) development unit 51 is installed, and at least one of the CMY development units is not installed, even if at least one of the CMY development units is installed, the control unit decides that the device is in the black monochrome printing mode. The printer driver of the host computer is notified of this mode information, and subsequently the host computer supplies print job data in a language used for monochrome printing.

In response to a monochrome printing command, the black (K) development unit 51 among the installed development units is controlled and rotated to the position of the photosensitive drum 20, and the development process is executed. Also, remaining toner amount information is maintained in the nonvolatile memory of the black (K) development unit 51; this remaining amount information is read, and whether development units are installed in each of the installation positions 50*a* to 50*d*, as well as toner color information and remaining toner amount information, are displayed on the display panel 95.

In FIG. 3, even if the magenta (M) or cyan (C) development unit, 53 or 52, is removed, the control unit judges the mode to be black monochrome printing mode.

In the example of FIG. 4, among CMYK development units, the yellow (Y) development unit 54 and magenta (M) development unit 53 are removed from the development device 50, and a black development unit 51 is installed in the magenta installation position 50*c*. In this state, color information is read from the nonvolatile memory provided in the development units 51 and 52, the installation states are detected by the control unit, and the device is detected as being in black monochrome printing mode. That is, when a plurality of black (K) development units 51 are installed in any of the installation positions, even if at least one CMY development unit is installed, the control unit decides that the mode is the black monochrome printing mode. The printer driver of the host computer is notified of this mode information, and subsequently the host computer supplies print job data in a language used for monochrome printing. In this case, among the plurality of black development units, a development unit with toner remaining is used.

In this case also, the toner amount remaining information in the nonvolatile memory of the black development unit 51 is maintained by writing, and is read out, so that the fact that three development units are installed, and the color information and toner amount remaining information for each, are displayed on the display panel 95.

Figure 5:
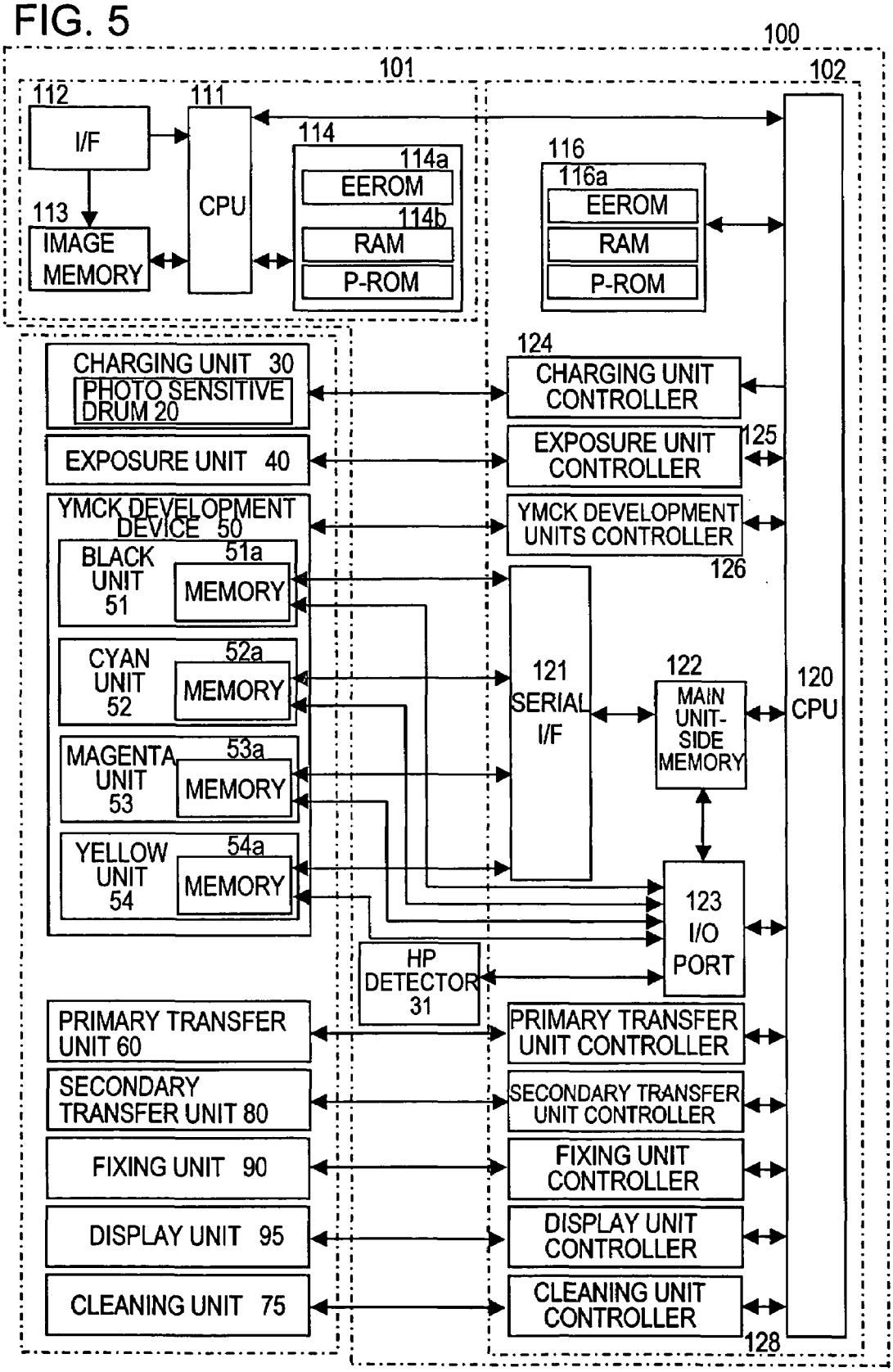
FIG. 5 shows the configuration of the control unit 100 in a present embodiment.

FIG. 5 shows the configuration of the control unit 100 in the embodiment. The control unit 100 has a main controller 101, to which is supplied print job data by the host computer, and which performs prescribed image processing and generates control signals as well as image signals. Further the control unit 100 has an engine controller 102, which controls each of the units of the printing engine. The main controller 101 has an interface 112 which receives print job data from the host computer; an image memory 113 which stores image data in the print job data; a CPU 111 which performs halftone processing and other image processing; and a memory unit 114, which has non-volatile memory 114*a* and RAM and program ROM 114*b*.

Mode information, indicating whether the printer is in color printing mode or is in monochrome printing mode, is stored in the non-volatile memory 114*a*. The printing mode is judged by the main controller 101 according to information from the memory of development units mounted in the development device when power is turned on; and the printing mode information of this judgment is written to the non-volatile memory 114*a*.

The engine controller 102 has, in addition to a CPU 120, a memory unit 116; a serial interface 121; main unit-side memory 122; an input/output port 123; driving control circuits 124, 125, 126 which drive the charging unit 30, exposure unit 40, and developing unit 50; and a driving control circuit group 128 which drives the primary transfer unit 60, secondary transfer unit 80, fixing unit 90, display unit 95, and cleaning unit 75. In addition, a detection portion 31 which detects the home position of the development device 50 is provided.

The engine controller 102 is supplied by the main controller 101 with control signals which control the printing process and image signals which control exposure beam irradiation, and executes control of each unit. The development units 51 through 54 mounted in the development device 50 each have respective development unit memory devices 51*a* to 54*a*. These memory device comprise, for example, FeRAM, EEPROM, or other non-volatile memory, and store such information as developing agent color information, remaining developing agent amount information, and development unit IDs. When these memory devices comprise FeRAM, non-contact access is possible via the serial interface 121; when comprising EEPROM, access is possible by physical connection to the serial interface 121. When power is turned on, and when a development unit is replaced or mounted, the engine controller 102 accesses the development unit memory devices 51*a* through 54*a* and reads information indicating whether a development unit is mounted, color information, and similar. In the development process, information on the amount of developing agent remaining is updated in the memory of a development unit for which the development process has ended.

The main unit-side memory 122 comprises for example EEPROM or other non-volatile memory, and stores parameter values for engine control and similar. The non-volatile memory 116*a* within the memory unit 116 stores information as to whether development units are mounted in the four mounting positions of the development device, and the colors of the mounted development units.

Figure 6A:
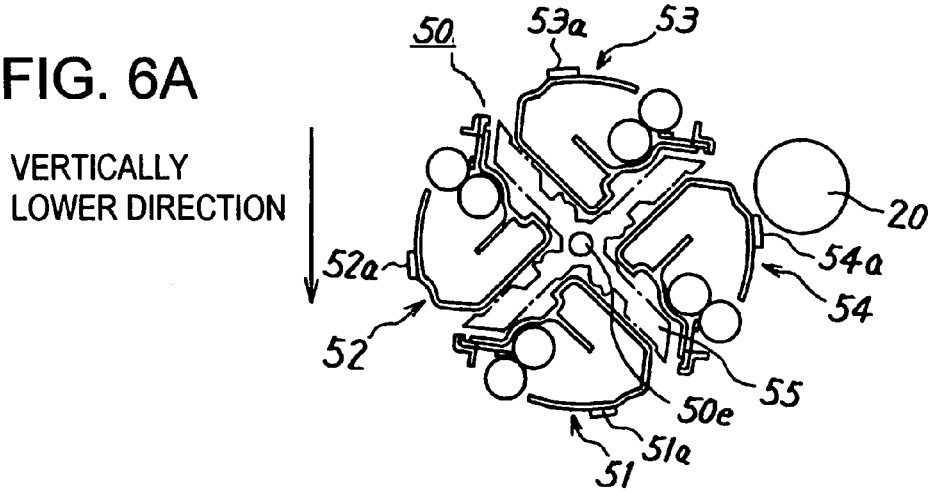
FIG. 6 shows rotation operation of the development device.
Figure 6B:
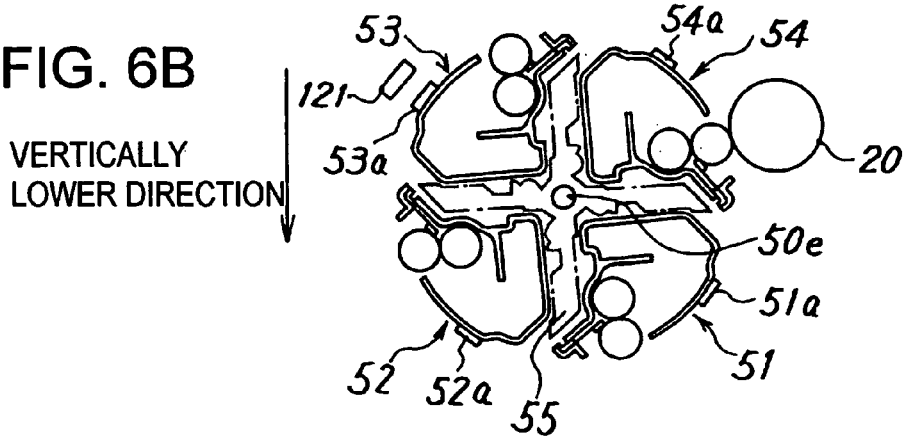
Figure 6C:
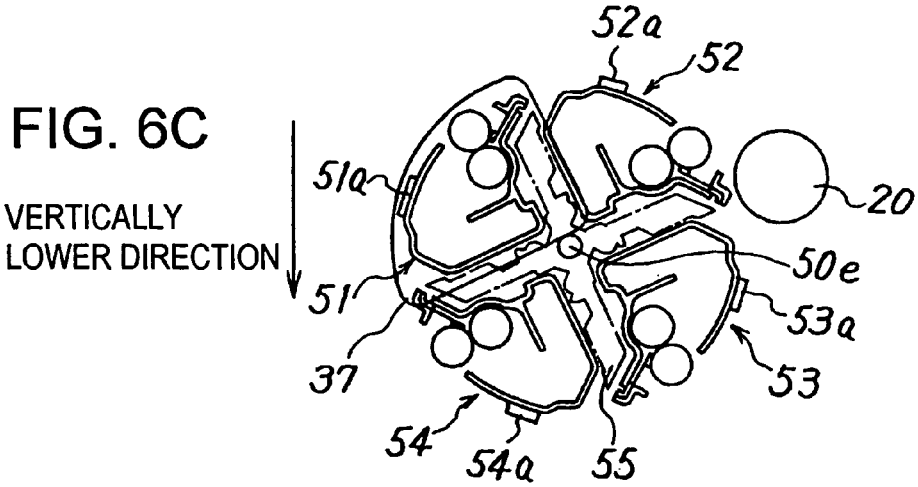
Figure 7A:
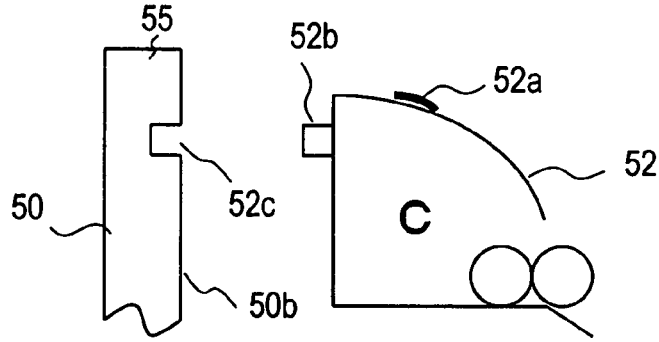
FIG. 7 shows means of joining the development device and development units.
Figure 7B:
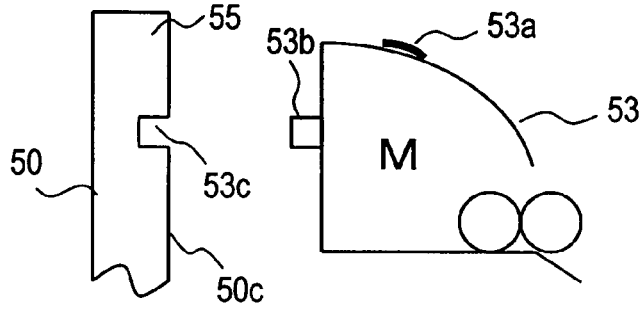
Figure 7C:
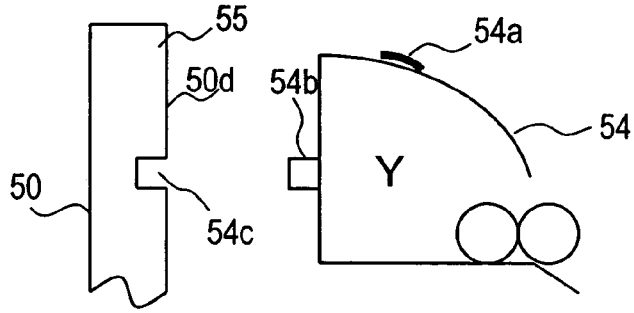
Figure 7D:
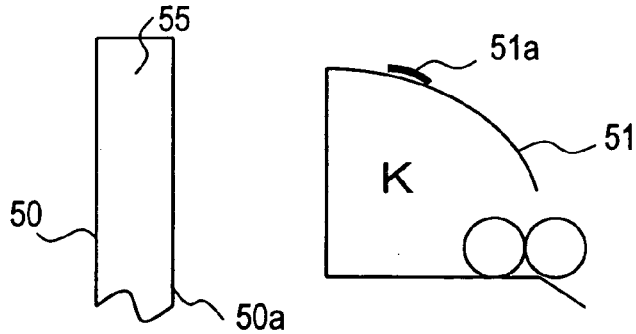

FIG. 6 shows the rotational operation of the development device. In FIG. 6, three positional relationships between the development device 50 with the four development units 51 to 54 mounted and the photosensitive drum 20 are shown. FIG. 6A shows the home position; FIG. 6B shows the development and memory access position; and FIG. 6C shows the development unit detachment position. The development device 50, which is a developing rotary, rotates about the center axis 50*e* due to a pulse motor, not shown; the center shaft 50*e* is fixed to a support frame 55 which holds the development unit.

The home position in FIG. 6A is a position detected by the home position detection portion 31 (FIG. 5), and is the reset position for developing rotary rotation control. In this position, the development unit is not aligned with the attachment/detachment hole 37 (in FIG. 6C), so that even if a development unit replacement panel (not shown) were opened, replacement of the development unit would be prevented.

In the development position in FIG. 6B, the development roller of the development unit 54 is brought into proximity with the photosensitive drum 20, and the developing agent of the development unit 54 is supplied to the photosensitive drum 20. Also, in this position the memory 53*a* of the development unit 53, which has just finished the development process, is accessed in contact-free fashion by the serial interface 121, information in the memory 53*a* is read, and the remaining developing agent amount information is updated. If non-contact access is used, no physical force need be applied to the development device even during the development process, so that the development process is not affected.

The attachment/detachment position in FIG. 6C is a position to which the development device is rotated when the replacement panel of the development unit is opened and a replacement button is pressed; in this position, the development unit 51 can be replaced via the replacement aperture 37. For example, each time the replacement button is pressed, the development device 50 is rotated by 90°, with control executed to rotate successive development units into the attachment/detachment position. Or, when the out-of-toner state is detected and development unit replacement is selected, in response to the replacement button, the development device 50 is rotated to the position of the development unit for which an out-of-toner state has been detected or to a position into which no development unit has been mounted. In place of the above replacement button, four mounting position buttons, corresponding to the four mounting positions, may be provided. In this case, when a mounting position button corresponding to a mounting position for replacement is pressed, the mounting position is rotated to the attachment/detachment position.

FIG. 7 shows the engaging means or element of the development device and development units. FIG. 7A shows the engaging structure between the cyan development unit 52 in the mounting position 50*b* and the support arm 55; the protrusion 52*b* of the development unit 52 and the depression 52*c* of the support frame 55 are formed so as to engage together. FIG. 7B shows the engaging structure between the magenta development unit 53 and the support frame 55 in the mounting position 50*c*; FIG. 7C shows the engaging structure between the yellow development unit 54 and the support frame 55 in the mounting position 50*d*. Similarly in these drawings, depressions 53*c*, 54*c* are provided on the side of the support frame 55 which engage with the protrusions 53*b*, 54*b* on the side of the development unit. FIG. 7D shows the structure of the black development unit 51 and the support frame 55 in the mounting position 50*a* thereof. No protrusion is formed in the black development unit 51, and accompanying this, no depression is formed in the support arm 55. Each development unit is inserted and retracted in the direction perpendicular to the plane of the paper, to be mounted or removed.

As is seen from the engaging structure shown in FIG. 7, protrusions 52*b*, 53*b*, 54*b* are provided at different positions on the CMY development units 52, 53, 54, and depressions 52*c*, 53*c*, 54*c* are provided at corresponding positions of the mounting positions 50*b*, 50*c*, 50*d* at which the former are mounted. By means of these engaging structure, the CMY development units can only be mounted in positions determined in advance. Mounting in positions other than predetermined positions is not possible. Using such physical engaging means in color printing mode ensures that CMYK development units are mounted in order in the predetermined positions, so that color printing is performed at high printing speed and with high image quality. On the other hand, no protrusion is formed on black development units 51, so that in addition to the black mounting position 50*a*, mounting in any of the other mounting positions 50*b*, 50*c*, 50*d* is also possible.

Figure 8:
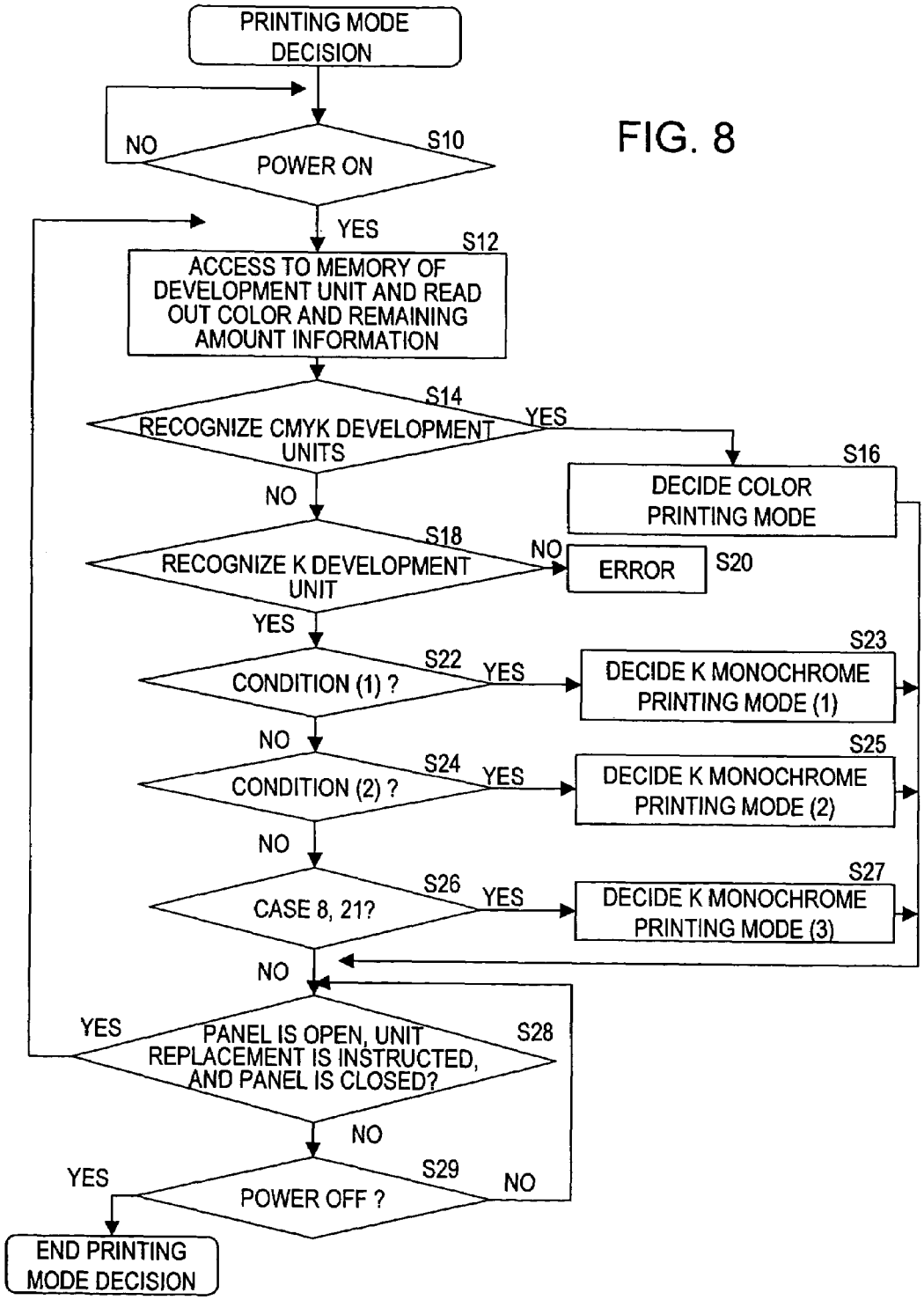
FIG. 8 is a flowchart showing printing mode decision operation in a present embodiment.

FIG. 8 is a flowchart showing printing mode decision operation in this embodiment. FIG. 9 shows a decision table in printing mode decision operation. In FIG. 9, the development unit column shows, for cases 1 through 21, the color (CMYK) of the development unit, if any, installed in each of the four installation positions PK, PC, PM, PY. The printing mode column indicates the printing mode decided in each case, and the decision condition column indicates the decision conditions under which decisions are made for each case.

In FIG. 8, when power to the control unit 100 which is control means of the printer 10 is turned on (S10), the development device is rotated to a memory access position, the nonvolatile memory of a development unit installed in the development device is accessed, and color information and remaining amount information for the development material are read (S12). When it is confirmed that black (K), magenta (M), cyan (C), and yellow (Y) development units are installed in the four installation positions of the development device (S14), the main controller 101 of the control unit 100 decides that the mode is the color printing mode, and writes the data to nonvolatile memory 114*a* (S16). This case corresponds to case 1 in FIG. 9.

When the main controller 101 of the control unit does not identify a black development unit installed in any of the four installation positions (S18), an error occurs, and an error is displayed on the display means 95 (S20).

When condition (1) is met, that is, one black development unit is installed in any one of the four installation positions, and at least one of the CMY development units is not installed, then even if at least one of the CMY development units is installed, the main controller 101 of the control unit decides that the mode is black monochrome printing mode (S22, S23). This condition (1) corresponds to cases 2 through 7 in FIG. 9. Cases 2 through 4 are states in which, starting from the color printing mode of case 1, one CMY development unit is removed. Cases 5 through 7 are cases in which, starting from the color printing mode of case 1, two CMY development units are removed. In cases 2 through 7, a black development unit need not necessarily be installed in the black installation position PK, but may be installed in any of the other installation positions PC, PM, PY. In the case of this condition (1), though resulting in an error decision in examples of the prior art, in this embodiment the mode is judged to be the monochrome printing mode. The decision result is written to nonvolatile memory 114*a*.

In the case of condition (2), that is, when a plurality of black development units are installed in any of the four installation positions, even if one or more CMY development units are installed, the main controller 101 of the control unit decides that the mode is the black monochrome printing mode (S24, S25). This condition (2) corresponds to cases 9 through 20 in FIG. 9. Cases 9 through 11 are states in which a black development unit is installed in an empty position in cases 2 through 4. Cases 12 through 14 are states in which black development units are installed in the two empty positions of case 5. Cases 15 through 17 are states in which black development units are installed in the two empty positions of case 6. And cases 18 through 20 are states in which black development units are installed in the two empty positions of case 7. In cases 12, 13, 15, 16, 18, 19, the black development units need not necessarily be installed in the black installation position PK, but may be installed in any of the other installation positions PC, PM, PY. In the case of condition (2) also, an error occurred in examples of the prior art, but in this embodiment the mode is decided to be the monochrome printing mode. The decision result is written to nonvolatile memory 114*a*.

Otherwise, in case 8 (in which a black development unit is installed in the black installation position PK) and in case 21 (in which black development units are installed in all installation positions) also, the main controller 101 of the control unit decided that the mode is the black monochrome printing mode (S26, S27). In cases other than case 8 also, if one, two or three black development units are installed in any positions, it is decided that the mode is the black monochrome printing mode.

The above series of decision processes S12 to S27 are also executed when the panel for development unit replacement is opened, an instruction button is pressed to replace a development unit, and then the replacement panel is closed (S28). When power is turned off, printing mode decisions end (S29).

The monochrome printing mode decision processes S22, S24, S26 of FIG. 8 may be performed according to a single decision condition. That is, as shown in FIG. 9, for conditions (3) corresponding to cases 2 to 21, that is, when at least one black development unit is installed in any of the installation positions, if case 1 does not obtain, the mode may be decided as monochrome printing mode regardless of the state of installation in installation positions other than the installation position of the black development unit. By using such a decision condition, a decision of monochrome printing mode can be made in the cases 2 to 21 in addition to the conventional example of case 8.

Figure 10:
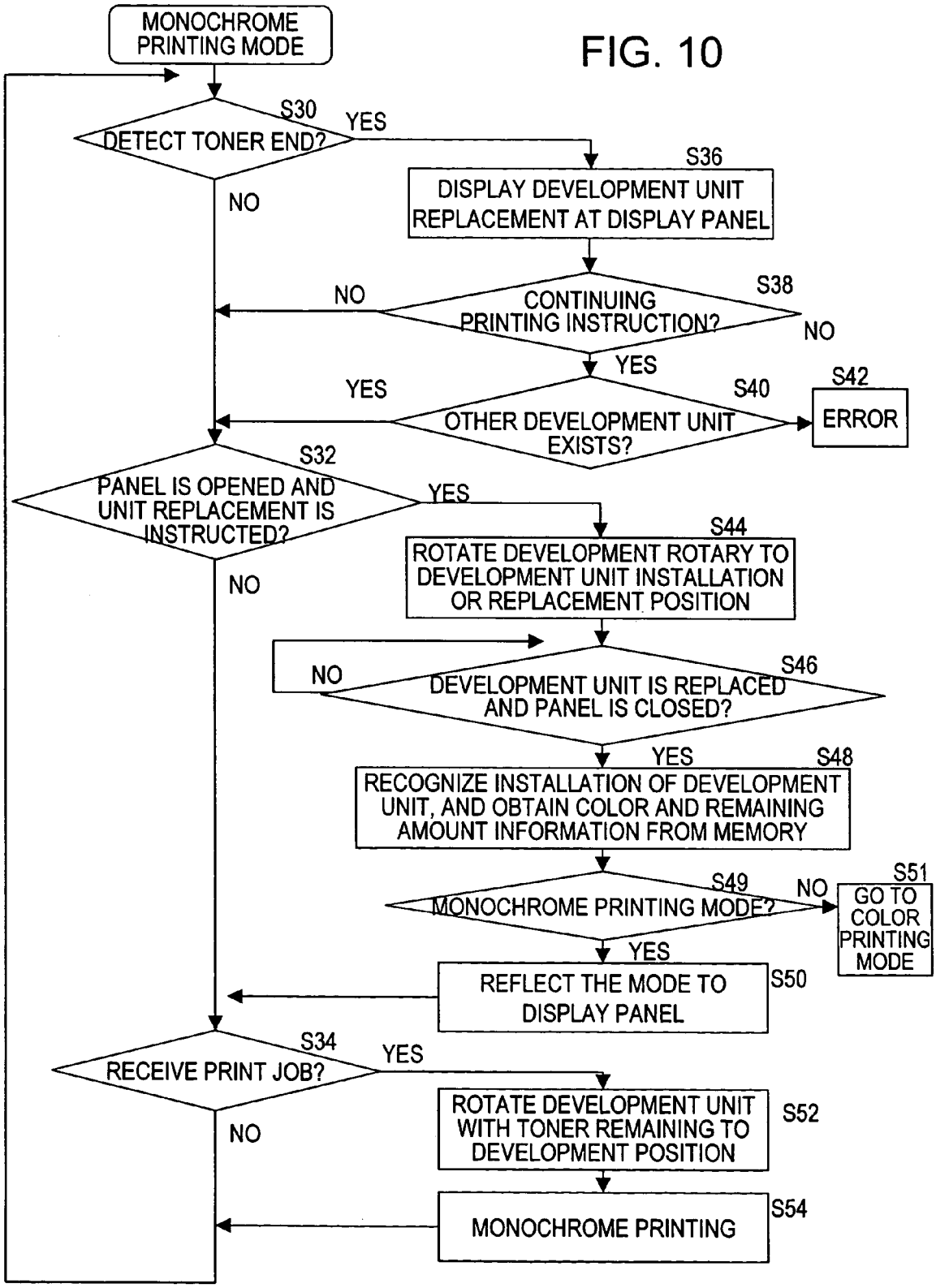
FIG. 10 is a flowchart showing operation in black monochrome printing mode.
Figure 12A:
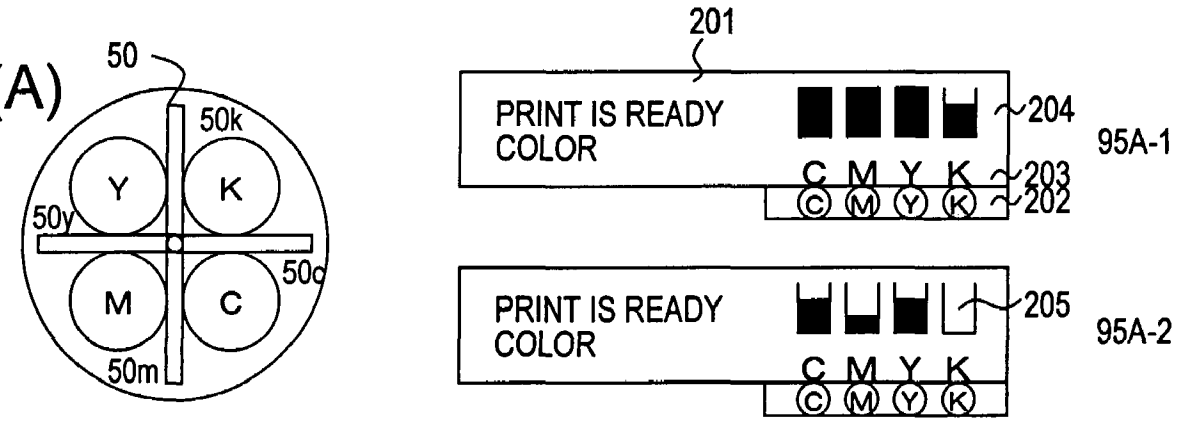
FIG. 12 shows examples of a development unit installation state and display panel display.
Figure 12B:
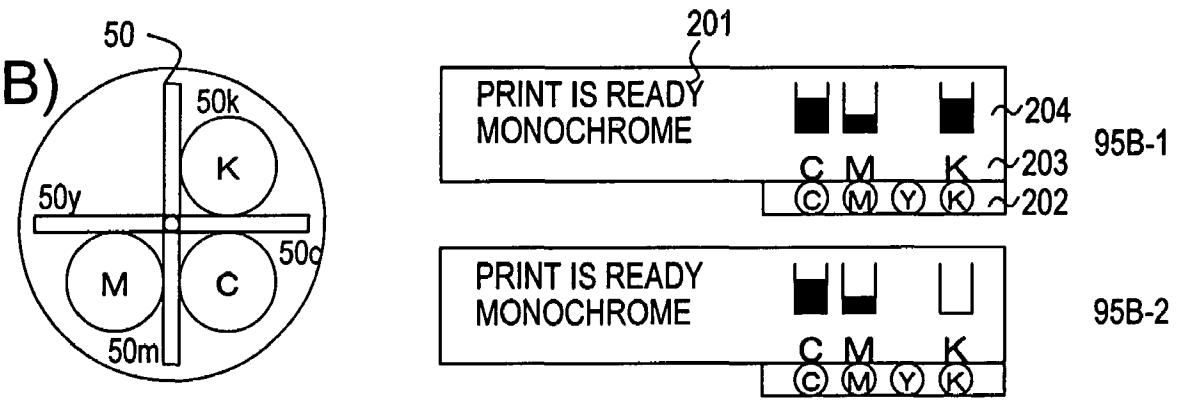

FIG. 10 is a flowchart showing operation in black monochrome printing mode. As explained in the printing mode decision operation of FIG. 8, when power is turned on the nonvolatile memory of installed development units is accessed, and color information and remaining amount information for each are read and displayed on the display panel 95. When it is decided that the mode is black monochrome printing mode, a display 201 indicating monochrome printing mode, as well as a display 204 indicating for each of the four installation positions 202 whether a development unit is installed and the amount of material remaining, and a display 203 indicating color information for installed development units, are displayed on the display panel 95, as shown in FIG. 12 and FIG. 13. The manner of display is described in detail below.

As shown in the flowchart of FIG. 10, when while in black monochrome printing mode the amount of developing material remaining in an installed development unit is detected to be 0% (S30), a display indicating replacement of the development unit due to an out-of-toner state of the development unit is displayed on the display panel 95 (S36). In black monochrome printing mode, installation of a plurality of black development units is permitted, and so if the user, upon viewing the remaining amount displays of installed development units as displayed on the display panel 95, sees that a development unit still containing material is installed, he may issue an instruction to continue printing by pressing a button on the operation panel or by means of the printer driver of the host computer. When an instruction to continue printing is input (S38), if there exists another development unit still containing material, no error occurs even if a development unit is not replaced; but if there exist no other development units still containing material, an error occurs (S40, S42). Further, when there is an instruction to continue printing and no error occurs, the development unit replacement instruction display disappears. When there is no instruction to continue printing, the display instructing replacement of a development unit continues to be displayed.

When the user opens the development unit replacement panel and presses a unit replacement instruction button (S32), the engine controller 102 of the control unit 100 controls rotation of the rotary of the development device such that the installation position for replacement matches the position of the replacement aperture (S44). In monochrome printing mode, a plurality of black development units can be installed, and so this rotation control is automatically controlled such that either an installation position with no installed development unit, or an installation position at which is installed a development unit with zero remaining material, matches the replacement aperture. The decision of which position to perform rotation to is performed by the control unit 100. Or, as described above, the user can use four installation position buttons to manually issue indicate the replacement position. In this case, information displayed on the display panel 95 aids the selection of the installation position button by the user.

When a development unit is installed or replaced, and the replacement panel is closed (S46), the control unit 100 accesses the memory of the development unit, identifies the installation position, and acquires color information and amount remaining information (S48). The control unit 100 then causes the display panel 95 to display the installation position, color information, and amount remaining information (S50). At this time, if the control unit 100 decides on switching to color printing mode (S49), switching to color printing mode is performed (S51).

When thereafter a print job is received from the host computer (S34), in the control unit 100, halftone processing and other image processing for which the main controller 101 is necessary is performed, and control signals and image data are output to the engine controller 102. The engine controller 102 rotates a development unit with toner remaining to the position of the photosensitive drum (S52) and uses this in execution of monochrome printing control (S54). The printer driver of the host computer has already been notified that the mode is monochrome printing mode, so that print job data for monochrome printing is transmitted from the host computer.

FIG. 11 is a flowchart showing operation in color printing mode. In color printing mode also, similarly to monochrome printing mode, operations are explained when an out-of-toner state is detected as an event (S60), when the development unit replacement panel is opened and a replacement instruction is issued (S62), and when a print job is received from the host computer (S64).

When an out-of-toner state is detected (S60), a development unit replacement instruction is displayed on the display panel 95. This replacement instruction comprises information indicating which color development unit in which installation position is out of toner. When a development unit in any of the CMY colors is out of toner, if a print continuation instruction is input by the user via the printer operation panel or the host computer (S68), the printer is switched to monochrome printing mode using the black development unit (S70). As a result, the printer becomes a dedicated monochrome printer.

When the development unit replacement panel is opened and a replacement button is pressed (S62), the development rotary, which is the development device, is controlled to rotate until the installation position of the development unit which is out of toner matches the replacement aperture. When the user presses any of the CMYK installation position buttons, that installation position is controlled to rotate so as to match the replacement aperture. Thereafter, when the development unit is replaced or removed and the replacement panel is closed (S74), the nonvolatile memory of the development device which has been replaced, removed or installed is accessed, and the fact of being installed or not installed as well as color information and remaining amount information are acquired (S78). As a consequence, the acquired information is reflected on the display panel (S80). At this time, the main controller of the control unit decides the printing mode, and if monochrome printing mode is detected, the printer is switched to monochrome printing mode (S70).

When print job data is received from the host computer (S64), the color printing process is executed (S82). In the color printing process, image data is sent to the engine controller in the order CMYK, and formation of a latent image through exposure of an image carrier, development of the latent image by a development unit, and primary transfer are performed in order. That is, the CMYK development units installed in installation positions in the development device, determined in advance, are controlled to rotate in order, for performing development processes in the respective colors.

FIG. 12 and FIG. 13 show examples of a development unit installation state and display panel display. In black monochrome printing mode, at least one black development unit is installed in an arbitrary position among the four installation positions of the development device, and the installation positions other than that of the black development unit may be in any state. Hence in order to inform the user of the position at which to install or replace a development unit when out of toner or at other times, the installation positions of development units and the color and remaining amount information for the developing material of each are displayed on the display panel 95. Display examples for two types of display panels each, 95A-1, 95A-2 to 95H-1, 95H-2, corresponding to the installation states (A) through (H) in FIG. 12 and FIG. 13, are shown.

(A) in FIG. 12 corresponds to case 1 in FIG. 9; development units in the CMYK colors are installed in the respective CMYK installation positions 50*c*, 50*m*, 50*y*, and 50*k* of the development device 50. In this installation state, a display indicating color printing mode 201 is displayed on the display panel for each of the CMYK installation positions 202, and a color information display 203, and an installation state and remaining amount information display 204 for the installed development units are displayed (95A-1). In display example 95A-2, as shown in 205, the fact that the remaining amount in the black development unit is zero is displayed; however, the fact that a black development unit is installed in the K installation position is also displayed. The installation position display 202 need not necessarily be displayed on the display panel 95, but may be displayed on a seal affixed in the vicinity of the display panel.

(B) in FIG. 12 corresponds to case 2 in FIG. 9, and is the state in which, starting from the installation state of (A) in FIG. 12, the Y development unit is removed. In this case, a monochrome printing mode display 201 appears on the display panel. Also, the fact that no development unit is installed in the Y installation position of the installation positions 202 is indicated by the color information display 203 and the installed/not-installed information and remaining amount information display 204. In the display example 95B-1, there is remaining black material, but in the display example 95B-2 there is no black material remaining.

(C) in FIG. 12 corresponds to case 5 in FIG. 9, and is the state in which, starting from the installation state (A) in FIG. 12, the Y and M development units are removed. In this case, the fact that development units are not installed in the M and Y installation positions is indicated in the display examples 95C-1 and 95C-2, and the fact that C and K development units are installed in the C and K installation positions, and remaining amount information for these, are displayed.

(D) in FIG. 12 corresponds to case 9 in FIG. 9. In the display examples 95D-1 and 95D-2, CMKK development units are installed in the CMYK installation positions. In the display example 95D-1, remaining amounts are displayed for each of the four development units, whereas in the display example 95D-2, the remaining amount information for the two black (K) development units is shown together. Through such a display, the frequency of replacement of development units when in monochrome printing mode can be reduced, and convenience to the user can be improved. When a plurality of black development units are installed, the user can select one of the display examples 95D-1 or 95D-2.

(E) in FIG. 13 corresponds to case 12 in FIG. 9. In this case, the remaining amount information for two black (K) development units is shown separately.

(F) in FIG. 13 corresponds to case 14 in FIG. 9. In this case, it is possible to select either an example in which remaining amount information for three black (K) development units is displayed separately (95F-1), or an example in which the information is displayed together (95F-2).

(G) in FIG. 13 corresponds to case 21 in FIG. 9. In this case also, it is possible to select either an example in which remaining amount information for four black (K) development units is displayed separately (95G-1), or an example in which the information is displayed together (95G-2).

(H) in FIG. 13 is an example in which, in case 3 of FIG. 9, a black development unit is installed in the Y installation position. In this case, the fact that CKY development units are installed corresponding to the CMY installation positions 202 is indicated by the color information display 203 and the installed/not-installed and remaining amount information display 204. Display example 95H-2 indicates that the K development unit installed in the M installation position is out of toner.

Figure 14:
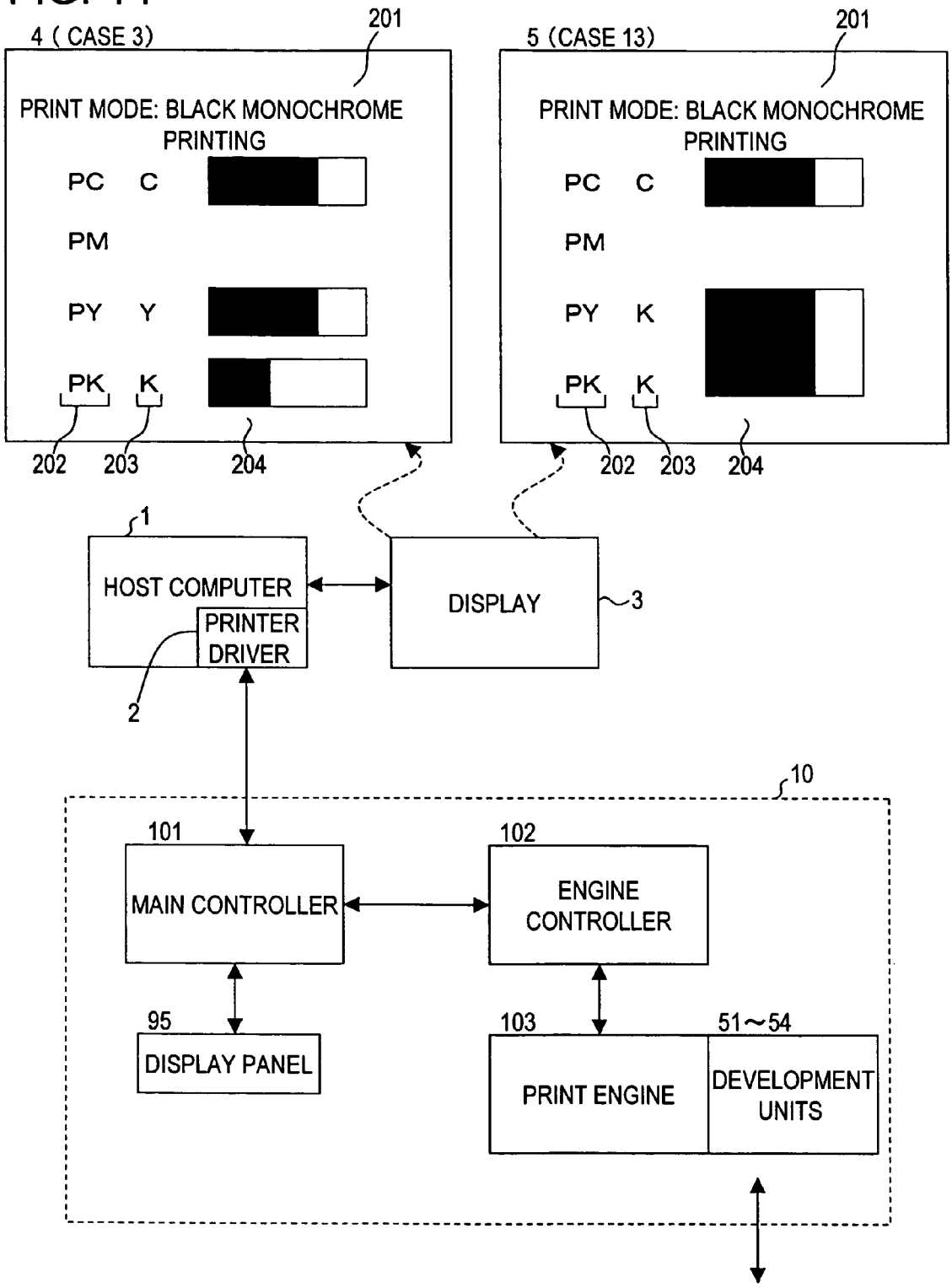
FIG. 14 shows examples of display by the printer driver of the host computer of development unit installation positions and toner remaining amounts; and, FIG. 15 is a flowchart of printer driver operation.

FIG. 14 shows examples of display by the printer driver of the host computer of installation positions and toner remaining amounts for development units. The printer 10 is connected to the host computer 1 either directly or via a network, and by means of a printer driver 2 installed in the host computer 1, screens 4, 5 comprising an installation position display 202, toner color information display 203 and amount remaining information display 204 for development units can be displayed on the display 3. The display example 4 corresponds to case 3 in FIG. 9; display example 5 corresponds to case 13. Display example 5 shows the combined toner amount remaining for two black development units.

When power is turned on and at other times, the main controller 101 obtains via the engine controller 102 the installation positions, color information, and toner amount remaining information for development units 51 to 54 within the engine 103 and notifies the printer driver 2 of the information. Thereafter, when the installation state of development units changes and when toner amount remaining information is updated, the printer driver 2 is notified of this information. On the monitor screen 3 of the host computer 1, a user can cause information indicating whether the printing mode is black monochrome printing mode, with a development unit is installed at each of the CMYK installation positions, toner color information, and toner amount remaining information to be displayed, as in the screens 4 and 5 shown in the drawing. The information displayed is the same as that on the display panel 95, and is the same as that explained using FIG. 12 and FIG. 13.

FIG. 15 is a flowchart of printer driver operation. When the printer power is turned on, the printer driver in the host computer is notified of this fact (S90). The control unit of the printer then reads the information in the nonvolatile memory of the development units, and upon judging the printing mode, the printer driver is notified of the printing mode decision (S92). The printer driver sets the printing mode of this notification (S94). Further, the printer driver is notified by the printer of the installation information, toner information, and toner amount remaining information for development units (S96), and the printer driver stores this information in computer memory and performs the screen display control indicated in FIG. 14 (S98). The above notifications S92 and S96 from the printer are performed by the printer in response to status requests (not shown) from the printer driver.

When a color print job instruction is issued by an application program on the host computer (S100), the printer driver checks the currently set printing mode, and if set to color printing mode, sends to the printer color print job data corresponding to the color print job command thus issued (S104). If monochrome printing mode is set, monochrome print job data corresponding to the color print job command thus issued is sent to the printer (S106). This sending of monochrome print job data may also be performed on condition that a warning of monochrome printing mode is first displayed, and then a monochrome printing execution command is then issued. As a result, while in monochrome printing mode, the printer operates as a dedicated monochrome printer.

On the other hand, when a monochrome print job command is issued by an application program in the host computer (S108), the printer driver checks the currently set printing mode, and if set to color printing mode, sends to the printer color print job data corresponding to the monochrome print job command issued (S112). That is, color print job data having only black image data is sent. Or, in process S112 monochrome print job data may be sent. When the printing mode is set to monochrome printing mode, monochrome print job data corresponding to the monochrome print job command issued is sent to the printer (S114). The above operation is performed until the power to the printer is turned off.

As explained above, if at least one among the CMY development units of a printer is removed, and a black (K) development unit is installed in any position, the printer operates in monochrome printing mode, and can operate as a dedicated monochrome printer. Hence the task of switching between color printing mode and monochrome printing mode is simplified, and it becomes simple to switch between operation as a color printer and a dedicated monochrome printer, so that convenience to the user is improved.

What is claimed is:

1. An image formation device, comprising:

an image carrier in which latent images are formed; and;

a development device into which a plurality of development units housing developing material are detachably installed, wherein when development units with a plurality of colors to form color images are installed in a plurality of installation positions of said development device, respectively, the image formation device operates in color printing mode; and wherein when at least one black development unit among said development units of the plurality of colors is installed in any position among said plurality of installation positions, and at least one among said development units of a plurality of colors other than black is not installed, even if at least one among said development units of the plurality of colors other than black is installed, the image formation device operates in monochrome printing mode; and wherein said development units have storage means for storing color information and remaining amount information for the developing material housed therewithin; and said image formation device further comprises:

control means for deciding said color printing mode or monochrome printing mode, according to the color information of said storage means of development units installed in said development device; and display means for displaying, for each of said plurality of installation positions, information indicating whether said development unit is installed, and color information and remaining amount information for the developing material of an installed development unit;

wherein said control means access the storage means of said development unit, as necessary, writes developing material amount remaining information for said development unit, reads color information and amount remaining information for said developing material, and for each of said plurality of installation positions, causes to be displayed on said display means information indicating whether a development unit is installed, and color information and amount remaining information for the developing material of an installed development unit.

2. An image formation device, comprising:

an image carrier in which latent images are formed; and a development device into which a plurality of development units housing developing material are detachably installed, wherein when development units with a plurality of colors to form color images are installed in a plurality of installation positions of said development device, respectively, the image formation device operates in color printing mode; and wherein when a plurality of black development units among said development units of the plurality of colors are installed in any of the positions among said plurality of installation positions, even if at least one among said development units of a plurality of colors other than black is installed, the image formation device operates in monochrome printing mode; and wherein said development units have storage means for storing color information and remaining amount information for the developing material housed therewithin; and said image formation device further comprises:

control means for deciding said color printing mode or monochrome printing mode, according to the color information of said storage means of development units installed in said development device; and display means for displaying, for each of said plurality of installation positions, information indicating whether said development unit is installed, and color information and remaining amount information for the developing material of an installed development unit;

wherein said control means access the storage means of said development unit, as necessary, writes developing material amount remaining information for said development unit, reads color information and amount remaining information for said developing material, and for each of said plurality of installation positions, causes to be displayed on said display means information indicating whether a development unit is installed, and color information and amount remaining information for the developing material of an installed development unit.

3. An image formation device, comprising:

an image carrier in which latent images are formed; and a development device into which a plurality of development units housing developing material are detachably installed, wherein when development units with a plurality of colors to form color images are installed in a plurality of installation positions of said development device, respectively, the image formation device operates in color printing mode; and wherein when all of said development units with the a plurality of colors are not installed, but at least one black development unit among said development units in the plurality of colors is installed in any of the positions among said plurality of installation positions, regardless of the installation states of said installation positions in which the black development unit is not installed, the image formation device operates in monochrome printing mode; and wherein said development units have storage means for storing color information and remaining amount information for the developing material housed therewithin; and said image formation device further comprises:

control means for deciding said color printing mode or monochrome printing mode, according to the color information of said storage means of development units installed in said development device; and display means for displaying, for each of said plurality of installation positions, information indicating whether said development unit is installed, and color information and remaining amount information for the developing material of an installed development unit;

wherein said control means access the storage means of said development unit, as necessary, writes developing material amount remaining information for said development unit, reads color information and amount remaining information for said developing material, and for each of said plurality of installation positions, causes to be displayed on said display means information indicating whether a development unit is installed, and color information and amount remaining information for the developing material of an installed development unit.

4. The image formation device according to one of claims 1, 2, and 3, wherein said control means cause said display means to display said color printing mode and monochrome printing mode in a manner enabling differentiation.

5. The image formation device according to claim 4, wherein said control means access the storage device of said development unit, as necessary, writes developing material amount remaining information for said development unit, and reads color information and amount remaining information for said developing material, and wherein said control means output, as required, to a host computer to which the image formation device is connected, data which causes to be displayed, for said plurality of installation positions, information indicating whether said development unit is installed, and color information and amount remaining information for the developing material of an installed development unit.

6. The image formation device according to claim 5, wherein said control means output, to said host computer, data which causes to be displayed said color printing mode and monochrome printing mode in a manner enabling differentiation.

7. The image formation device according to any of claims 1, 2 or 3, wherein, when in said color printing mode the amount of developing material remaining in any of said development units other than black among said development units with the plurality of colors becomes zero, operation switches to said monochrome printing mode in response to input of a monochrome printing instruction.

8. The image formation device according to any of claims 1, 2 or 3, further comprising a driver program installed on a host computer connected to said image formation device, and wherein, in response to a color printing command when said image formation device is in said monochrome printing mode, the driver program causes said host computer to execute a procedure of transmitting printing data corresponding to monochrome printing mode to said image formation device.

9. The image formation device according to any of claims 1, 2 or 3, wherein said development units with the plurality of colors are installed, via separate engagement means, into said plurality of installation positions in said development device; and said black development unit has engagement means which can be installed in any of said plurality of installation positions.

10. An image formation device, comprising:

an image carrier in which latent images are formed; and a development device into which a plurality of development units housing developing material are detachably installed, wherein when development units with a plurality of colors to form color images are installed in a plurality of installation positions of said development device, respectively, the image formation device operates in color printing mode;

when all of said development units with the plurality of colors are not installed, but a black development unit among said development units with the plurality of colors is installed in any of the positions among said plurality of installation positions, the image formation device operates in monochrome printing mode;

said development units each having a storage unit for storing color information and amount remaining information for the developing material housed therein; and, said image formation device further comprising a display unit for simultaneously displaying, for each of said plurality of installation positions, information indicating whether said development unit is installed, and the color information and amount remaining information for developing material in the installed development unit, according to the color information and amount remaining information stored in said storage unit of said development unit installed in said development device.

11. An image formation device, comprising:

an image carrier in which latent images are formed; and a development device into which a plurality of development units housing developing material are detachably installed, wherein when development units with a plurality of colors to form color images are installed in a plurality of installation positions of said development device, respectively, the image formation device operates in color printing mode;

when all of said development units with the plurality of colors are not installed, but a black development unit among said development units with the plurality of colors is installed in any of the positions among said plurality of installation positions, the image formation device operates in monochrome printing mode;

said development units each having a storage unit for storing color information and amount remaining information for the developing material housed therein; and, said image formation device further comprising a control unit for outputting, to a host computer connected to the image formation device, data for simultaneously displaying, for said plurality of installation positions, information indicating whether said development unit is installed, and the color information and amount remaining information for developing material in installed development unit, according to the color information and amount remaining information stored in said storage unit of said development unit installed in said development device.

12. An image formation device, comprising:

an image carrier in which latent images are formed; and a development device into which a plurality of development units housing developing material are detachably installed, wherein when development units with a plurality of colors to form color images are installed in a plurality of installation positions of said development device, respectively, the image formation device operates in color printing mode;

when all of said development units with the plurality of colors are not installed, but a black development unit among said development units with the plurality of colors is installed in any of the positions among said plurality of installation positions, the image formation device operates in monochrome printing mode; and said image formation device further comprises a display unit for simultaneously displaying, for each of said plurality of installation positions, color information and amount remaining information for developing material in the installed development units.

* * * * *